US005937336A

United States Patent [19]

Kumagai

[11] Patent Number: 5,937,336

[45] Date of Patent: Aug. 10, 1999

[54] TRANSMISSION/RECEPTION APPARATUS

[75] Inventor: Yoshiaki Kumagai, Kawasaki, Japan

[73] Assignee: Fujitsu Limited, Kanagawa, Japan

[21] Appl. No.: 08/879,626

[22] Filed: Jun. 20, 1997

[30] Foreign Application Priority Data

Dec. 27, 1996 [JP] Japan ..... 8-351469

[51] Int. Cl.[6] ..... H01Q 11/12

[52] U.S. Cl. ..... 455/126; 455/69; 455/127; 455/522

[58] Field of Search ..... 455/126, 127, 455/69, 522

[56] References Cited

U.S. PATENT DOCUMENTS

| | | | |
|---|---|---|---|
| 5,129,098 | 7/1992 | McGirr et al. | 455/126 |
| 5,313,658 | 5/1994 | Nakamura | 455/69 |
| 5,459,426 | 10/1995 | Hori | 455/126 |
| 5,487,179 | 1/1996 | Larsson | 455/69 |
| 5,524,287 | 6/1996 | Yokoya et al. | 455/126 |
| 5,606,285 | 2/1997 | Wang et al. | 455/126 |
| 5,655,220 | 8/1997 | Weiland et al. | 455/69 |
| 5,697,074 | 12/1997 | Makikallio et al. | 455/126 |
| 5,710,991 | 1/1998 | Lee | 455/126 |
| 5,715,527 | 2/1998 | Horii et al. | 455/126 |
| 5,737,697 | 4/1998 | Yamada | 455/126 |
| 5,752,171 | 5/1998 | Akiya | 455/126 |
| 5,802,110 | 12/1998 | Watanabe et al. | 455/522 |
| 5,852,770 | 12/1998 | Kasamatsu | 455/126 |

*Primary Examiner*—Dwayne D. Bost
*Assistant Examiner*—Quochien Ba Vuong
*Attorney, Agent, or Firm*—Helfgott & Karas, PC.

[57] ABSTRACT

A transmission/reception apparatus consists of a transmitter section including a gain amplifier which amplifies a gain of the transmission signal, power amplifier which amplifies the output of the gain amplifier, and transmission monitor signal extractor which extracts a transmission monitor signal from the transmission signal produced by the power amplifier, a receiver section including a coupler which couples the output of the transmission monitor signal extractor to the reception signal, low-noise amplifier which amplifies the output of the coupler, and separator which separates the output of the low-noise amplifier, and a controller including at least a gain controller which controls the gain amplifier based on a prescribed control reference and the output of the separator. The apparatus is capable of controlling the transmission output in a wide range by amplifying a weak transmission monitor signal in the receiver section.

8 Claims, 23 Drawing Sheets

| D7 | D6 | ATTENUATOR SETTING | | | DEGREE OF ATTENUATION |
|---|---|---|---|---|---|
| 0 | 0 | 0 | 0 | 0 | 0dB |
| 0 | 1 | 0 | 1 | 0 | 20dB |
| 1 | 0 | 1 | 0 | 0 | 40dB |
| 1 | 1 | 1 | 1 | 0 | 60dB |

FIG. 17

| COMPARATOR INPUT | ANALOG SWITCH STATE | REMARKS |
|---|---|---|
| $V_{01} \leq V_1$ | A-C | |
| $V_{02} \leq V_1 \leq V_{01}$ | A-C | $V_1$ ↘ |
| | B-C | $V_1$ ↗ |
| $V_1 \leq V_{02}$ | B-C | |

TRANSMISSION/RECEPTION APPARATUS

BACKGROUND OF THE INVENTION

1. Field of the Invention

The present invention relates to a transmission/reception apparatus suitable for CDMA (Code Division Multiple Access) using the multiple access scheme, and particularly to the transmission output control of the CDMA-based transmission/reception apparatus for the mobile radio communication equipment.

2. Description of the Related Art

As a transmission scheme of mobile radio communication, attention is paid recently to the spread-spectrum CDMA system which is superior in the efficiency of use of frequencies. This system is already put into practice in some fields, and it is a powerful candidate of the next-generation mobile communication system (FPLMTS: Future Public Land Mobile Telecommunication System) for the radio communication between a base station and multiple local stations.

The CDMA is designed to spread the radio wave of each station based on an unique high-speed code. Specifically, at a same time point and in a same frequency band, the sending station sends signals based on different spread codes on individual communication channels, and each receiving station retrieves only information signals on the communication channel to that station based on the spread codes assigned to it.

Other multiple access schemes include the TDMA (Time Division Multiple Access) system which transmits multiple input channel signals on a time-slice basis, and the FDMA (Frequency Division Multiple Access) system which transmits multiple input channel signals simultaneously and separately by assigning different carrier frequencies.

Among these multiple access schemes, the CDMA system which bases the resource on electric power is required of wide-range continuous control of transmission output (specifically, 80 dB for local stations) for the sake of efficient transmission. Namely, local stations are required to control their transmission outputs so that all signal levels are equal at the reception by the base station.

FIG. 22 is a block diagram showing the arrangement of a typical CDMA terminal equipment. The CDMA terminal 70 includes a codec 41, a vocoder 42, a microprocessor (MPU) 43, an encoder/decoder 44A, an interleaver/deinterleaver 44B, a spreader/modulator 45, a transmitter/receiver 46, an antenna 47, and a despreader/demodulator 48.

The codec 41 converts an analog audio signal entered to the terminal into digital data, i.e., code conversion, and the vocoder 42 determines the capacity (rate) of the input signal, i.e., in sending mode, it determines the capacity of digital audio data provided by the codec 41 and sends the result to the microprocessor 43 which will be explained shortly, and in receiving mode, it processes audio data based on the capacity provided by the microprocessor 43 and delivers the resulting audio signal as the output of the terminal.

The microprocessor (MPU) 43 sets and releases a call, and the encoder/decoder 44A encodes and decodes data and, particularly at decoding, it releases data (symbols) provided by the interleaver/deinterleaver 44B as reception data.

The interleaver/deinterleaver 44B consists of an interleaver section which functions to rearrange the sequence of signal and recover defective information based on time-shuffling thereby to improve the signal quality on the transmission path, and a deinterleaver section which functions to restore the original sequence of signal by rearranging the output (symbols) from the despreader/demodulator 48 which will be explained shortly based on a prescribed time reference (timing). The spreader/modulator 45 spreads and modulates the encoded transmission data.

The transmitter/receiver 46 implements the process for sending and receiving information to/from the base station (not shown) through the antenna 47 which will be explained shortly, and it consists of a transmitter section 46A, a DUP 46B, and a receiver section 46C.

The transmitter section 46A implements the frequency amplifying process for the output of the spreader/modulator 45 based on the transmission gain control signal provided by the despreader/demodulator 48, which will be explained shortly, for the transmission to the base station. The DUP 46B implements the branching process for directing the output of the transmitter section 46A as a transmission output to the antenna 47, and directing the radio wave introduced by the antenna 47 as a reception input to the receiver section 46C.

The receiver section 46C implements the amplifying process for the radio wave from the base station. The antenna 47 receives the radio wave which is transmitted by the base station over the radio communication path (not shown), and transmits the signal produced by the terminal in the form of radio wave. The despreader/demodulator 48 implements the demodulation process thereby to convert the spread-encoded data back to the original data, and produces the transmission gain control signal for the transmitter section 46A based on the information from the based station.

At signal transmission to the base station by the CDMA terminal 70 arranged as described above, the codec 41 digitizes the audio signal into digital data and the vocoder 42 determines the capacity (rate) of the digital audio data. The microprocessor 43 sets a call, the encoder/decoder 44A encodes the audio data, and the interleaver section of the interleaver/deinterleaver 44B rearranges the sequence of signal.

The spreader/modulator 45 implements the modulation and spreading processes for the output of the interleaver/deinterleaver 44B, and the transmitter section 46A implements the frequency amplifying process for the transmission to the base station based on the transmission gain control signal provided by the despreader/demodulator 48. The DUP 46B directs the resulting transmission output in the form of a radio wave to the antenna 47 for transmission.

At signal reception from the base station, the receiver section 46C receives the radio wave from the antenna 47 by way of the DUP 46B and amplifies the reception signal, the despreader/demodulator 48 implements the demodulation and despreading processes, and the deinterleaver section of the interleaver/deinterleaver 44B restores the original sequence of signal. The encoder/decoder 44A decodes the reception signal, and the microprocessor 43 controls the signal and extracts audio data and display/control data from the reception data. The vocoder 42 processes the audio data depending on the capacity of delivery, and the codec 41 converts the audio data back to the analog audio signal to be delivered as the output of the CDMA terminal 70.

FIG. 23 is a block diagram showing the arrangement of a typical transmitter/receiver. The transmitter/receiver 50 consists of a transmitter section 50A including a gain amplifier 20, power amplifier 21, transmission monitor signal extractor 22, and transmission filter 23, a receiver section 50B including a reception filter 28 and low-noise amplifier 29, a circulator 26, and an antenna 27. The transmission monitor signal extractor 22 has its part of output fed back to the gain amplifier 20 by way of a detection circuit 24 and controller 25.

The antenna 27 transmits and receives signals to/from other radio communication equipment over the radio communication path (not shown), and the circulator 26 is rotating to direct the transmission output from the transmitter section 50A to the antenna 27 and direct the reception input from the antenna 27 to the receiver section 50B.

The gain amplifier 200 amplifies a gain of the transmission signal by being controlled by the controller 25 which will be explained shortly, the power amplifier (PA) 21 amplifies the output of the gain amplifier 20, and the transmission monitor signal extractor 22 extracts the transmission monitor signal from the output of the power amplifier 21.

The transmission filter 23 renders the band confinment for the output of the transmission monitor signal extractor 22, and the band-confined transmission output is directed by the circulator 26 to the antenna 27 for transmission.

The detection circuit 24 implements the detection for the transmission monitor signal extracted by the transmission monitor signal extractor 22, and the controller 25 compares the resulting DC signal of the detection circuit 24 with a prescribed reference level and controls the gain of the gain amplifier 20 so that the amplified output is within a certain range. Based on the feedback of the extracted transmission monitor signal to the gain amplifier 20, the transmission output on the antenna 27 has a constant amplitude.

The reception filter 28 renders the band confinment for the reception input provided by the antenna 27 through the circulator 26, and the low-noise amplifier 29 amplifies the reception signal released by the reception filter 28.

At signal transmission by the transmitter/receiver 50 arranged as shown in FIG. 23, the transmission signal is amplified by the gain amplifier 20, with its output being further amplified by the power amplifier 21. The transmission monitor signal extractor 22 extracts from the amplified transmission signal the transmission monitor signal, which is subjected to detection by the detection circuit 24, and the controller 25 controls the amplification gain so that the amplitude of transmission signal is within a certain range. The transmission filter 23 renders the band confinment for the transmission signal, and the resulting transmission output is directed by the circulator 26 to the antenna 27 for transmission.

At signal reception, the antenna 27 receives the radio wave signal sent over the radio communication path, the reception input is directed by the circulator 26 to the reception filter 28, by which the signal is rendered the band confinment, and the low-noise amplifier 29 amplifies the resulting reception signal.

However, the detection circuit 24 of the transmitter/receiver 50 has a range of detection of 20 dB at most in general. Although this detection range is deemed sufficient for the case of the fixed transmission output power and the case of the switching of transmission output power, the circuit will suffer the deficiency when it is intended to compensate the shadowing (interruption of radio wave by a building, etc.) and multi-path-phasing (interference of radio wave with reflected radio waves) besides the variation of communication distance in mobile communication. Particularly, in the case of CDMA in which the transmission output is a resource shared among stations, a control range as wide as 80 dB is required, and this circuit is not capable of coping with the above-mentioned various radio wave disturbances.

Moreover, because of a limited output of the transmitter section 50A, what will be in question at the expansion of control range of transmission output is the lower side of the detection level. The decrease of signal level on the input of the detection circuit 24 causes the detection voltage to fall and the transmission monitor signal to be hidden in the noise, resulting in the failure of detection.

SUMMARY OF THE INVENTION

In view of the foregoing prior art deficiencies, it is an object of the present invention to provide a transmission/reception apparatus capable of controlling the transmission output in a wide range by amplifying a weak transmission monitor signal in the receiver section.

In order to achieve the above objective, the present invention resides in a transmission/reception apparatus which comprises a transmitter section including a gain amplifier which amplifies variably the transmission signal, power amplifier which amplifies the output of the gain amplifier, and transmission monitor signal extractor which extracts a transmission monitor signal from the transmission signal produced by the power amplifier, a receiver section including a coupler which couples the output of the transmission monitor signal extractor to the reception signal, low-noise amplifier which amplifies the output of the coupler, and separator which separates the output of the low-noise amplifier, and a controller including at least a gain controller which controls the gain amplifier based on a prescribed control reference and the output 20 of the separator.

Namely, the inventive transmission/reception apparatus operates by feeding back the transmission signal after the signal is amplified in the receiver section, whereby it is advantageous in that the control range of transmission output can be expanded, while minimizing the increase of the scale of circuit, and the processing ability of the apparatus is improved significantly.

The inventive transmission/reception apparatus includes a variable attenuator which is inserted on the path between the transmission monitor signal extractor and the coupler and adapted to attenuate variably the transmission monitor signal, and a variable attenuation controller which controls the degree of attenuation of the variable attenuator depending on the transmission signal level.

The inventive transmission/reception apparatus has its variable attenuation controller designed to increase the degree of attenuation of the variable attenuator in a first mode of high transmission signal level or decrease the degree of attenuation of the variable attenuator in a second mode of low transmission signal level.

Namely, the inventive transmission/reception apparatus has the variable attenuator located between the transmission monitor signal extractor and the coupler, and is capable of switching the degree of attenuation such that it is high when the transmission signal level is high or it is low or nullified when the transmission signal level is low, whereby it is advantageous in that the control range of transmission output can be expanded, while minimizing the increase of the scale of circuit, and the amplifying process of the receiver section can be made efficient.

The inventive transmission/reception apparatus includes a first selector switch which is inserted on the path between the transmission monitor signal extractor and the coupler and adapted to direct the transmission monitor signal selectively depending on the transmission signal level, a second selector switch which is inserted on the path between the separator and the gain controller and adapted to direct selectively the output of the separator or the output of the first selector switch to the gain controller, and a switch controller which is included in the controller and adapted to operate the first selector switch to have its output directed to the second selector switch and operate the second selector switch to have its input receiving the output of the first selector switch in a first mode of high transmission signal level, or operate the first selector switch to have its output directed to the coupler and operate the second selector switch to have its input receiving the output of the separator in a second mode of low transmission signal level.

Namely, the inventive transmission/reception apparatus has the first selector switch located between the transmission monitor signal extractor and the coupler and the second selector switch located between the separator and the gain controller so that the transmission signal is fed back to the gain controller by jumping the receiver section in the first mode of high transmission signal level or the transmission signal is fed back to the gain controller following the amplification by the receiver section in the second mode of low transmission signal level and in need of amplification, whereby it is capable of expanding the control range of transmission output, while minimizing the increase of the scale of circuit, and minimizing the power consumption of the receiver section, and it contributes significantly to the flexible system organization.

The inventive transmission/reception apparatus includes a distributor which is inserted on the path between the transmission monitor signal extractor and the coupler and adapted to distribute the transmission monitor signal in a prescribed proportion, a selector which directs selectively the output of the separator or the output of the distributor to the gain controller, and a selector controller which is included in the controller and adapted to control the selector to select the output of the distributor in a first mode of high transmission signal level or select the output of the separator in a second mode of low transmission signal level.

Namely, the inventive transmission/reception apparatus has the distributor located between the transmission monitor signal extractor and the coupler and the selector located between the separator and the gain controller so that the output of the distributor is selected by the selector and fed back to the gain controller by jumping the receiver section in the first mode of high transmission signal level, or the output of the separator is selected by the selector and fed back to the gain controller following the amplification by the receiver section in the second mode of low transmission signal level, whereby it is capable of expanding the control range of transmission output, while minimizing the increase of the scale of circuit, and selecting the high-quality transmission monitor signal, and it contributes significantly to the enhancement of performance of the apparatus.

The inventive transmission/reception apparatus includes a detection circuit which implements the detection of the transmission monitor signal and delivers the detection output to the gain controller.

The inventive transmission/reception apparatus includes a filter which is located on the output side of the separator and adapted to render the band confinment for the transmission signal.

The inventive transmission/reception apparatus includes a filter which is inserted on the path between the separator and the gain controller and adapted to render the band confinment for the reception signal.

Namely, the inventive transmission/reception apparatus feeds back the transmission signal following the amplification by the receiver section, whereby it is advantageous in that the control range of transmission output can be expanded, while minimizing the increase of the scale of circuit, and the processing ability of the apparatus is improved significantly.

BRIEF DESCRIPTION OF THE DRAWINGS

FIG. 17 is a diagram showing a specific example of the switching operation of the comparator in the selection control system of the fourth embodiment;

DESCRIPTION OF THE PREFERRED EMBODIMENTS

Embodiments of the present invention will be explained with reference to the drawings.

(a) Embodiment 1

Figure 1:
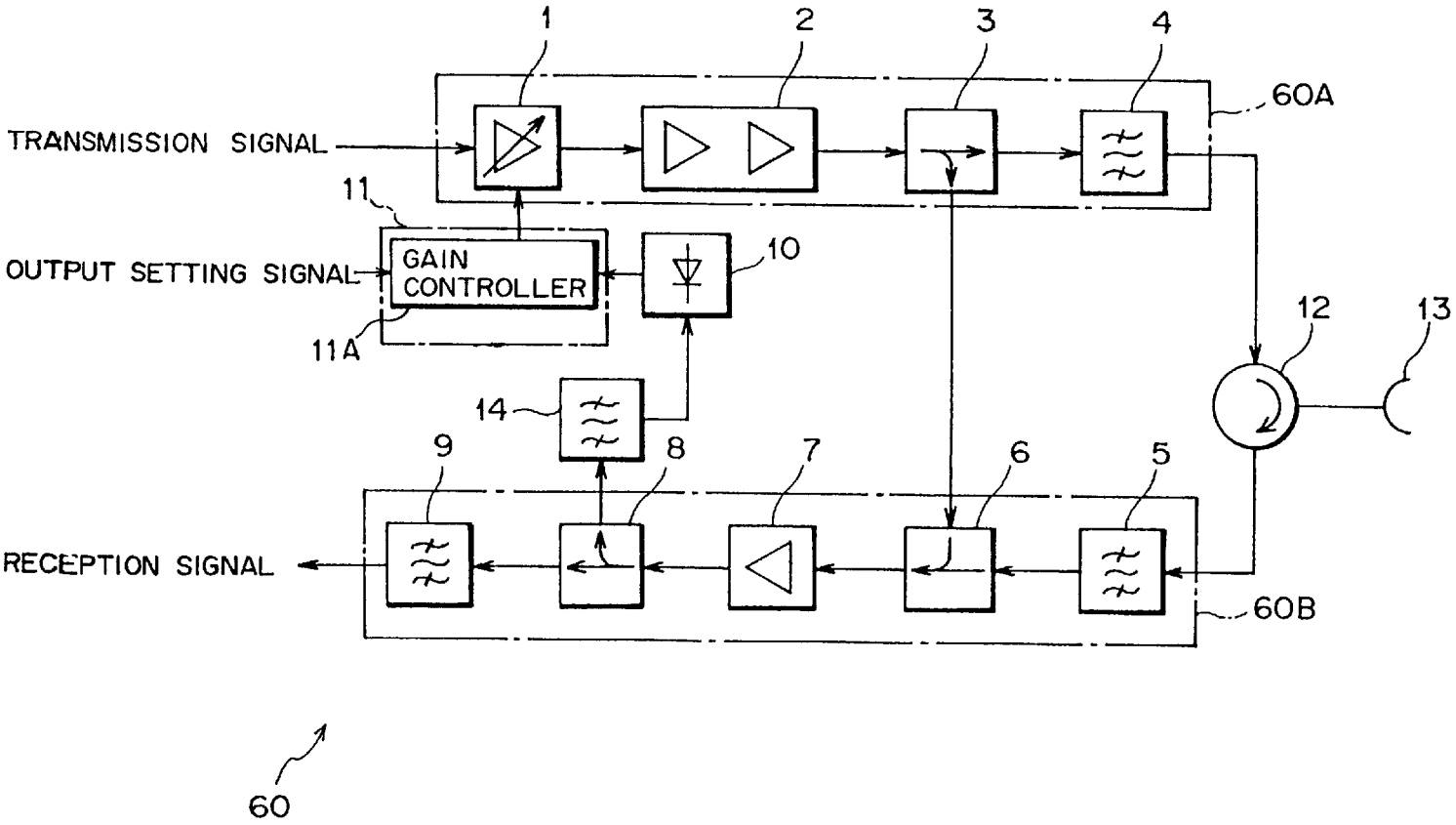
FIG. 1 is a block diagram showing the arrangement of the transmission/reception apparatus based on a first embodiment of this invention.

FIG. 1 shows the arrangement of the transmission/reception apparatus based on the first embodiment of this invention. In the figure, the transmission/reception apparatus 60 consists of a transmitter section 60A including a gain amplifier 1, power amplifier 2, transmission monitor signal extractor 3, and transmission filter 4, a receiver section 60B including a first reception filter 5, coupler 6, low-noise amplifier 7, separator 8 and second reception filter 9, a circulator 12, an antenna 13, and a filter 14, detection circuit 10 and controller 11 connected in series between the separator 8 and gain amplifier 1. The transmission monitor signal extractor 3 is connected to the coupler 6.

Among these circuit sections, the gain amplifier 1, power amplifier 2, transmission monitor signal extractor 3, transmission filter 4, first reception filter 5, low-noise amplifier (reception signal amplifying circuit) 7, circulator 12 and antenna 13 all function identically to the gain amplifier 20, power amplifier 21, transmission monitor signal extractor 22, transmission filter 23, reception filter 28, low-noise amplifier 29, circulator 26 and antenna 27, and detailed explanation thereof will be omitted.

The coupler 6 receives the reception signal through the first reception filter 5, and couples the reception signal with the output of the transmission monitor signal extractor 3. The separator 8 separates the output of the low-noise amplifier 7, with one separated output being used to control the transmission output. The second reception filter 9 located at the output of the separator renders the band confinment against the transmission signal, thereby drawing the reception signal out of the mixture of the transmission signal and reception signal.

The filter 14 located between the separator 8 and a gain controller 11A which will be explained shortly renders the band confinment against the reception signal, thereby drawing the transmission signal out of the mixture of the transmission signal and reception signal.

Figure 4:
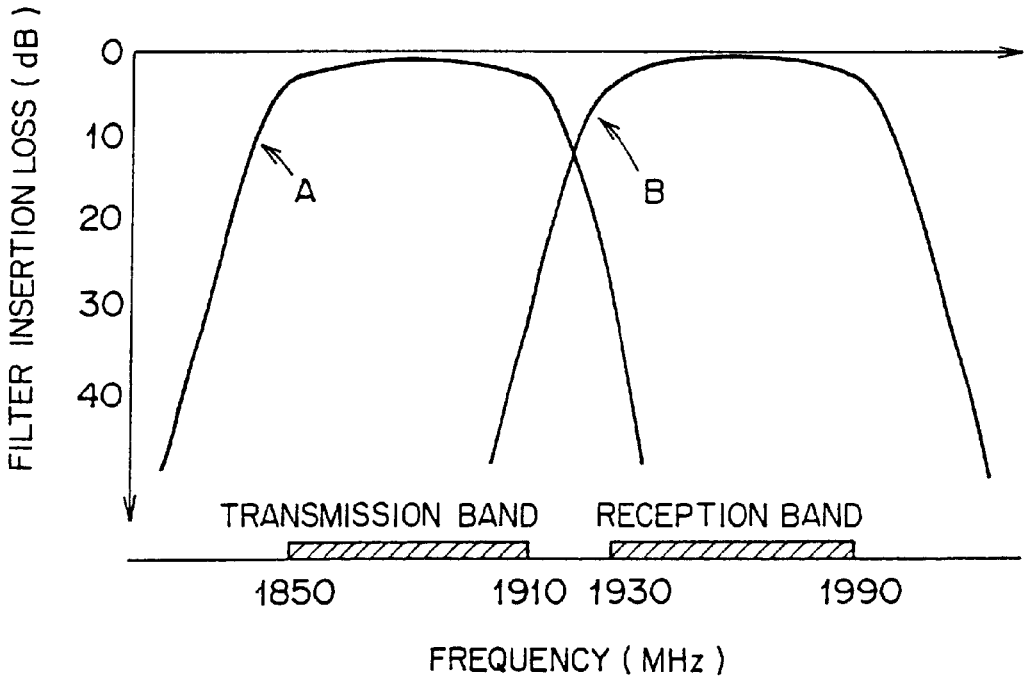
FIG. 4 is a diagram used to explain the transmission band and reception band based on the first embodiment.

These filters have their frequency bands set as shown in FIG. 4. Specifically, the transmission band is from 1850 MHz to 1910 MHz as indicated by A, and the reception band is from 1930 MHz to 1990 MHz as indicated by B. The filter 14 and second reception filter 9 implement the band confinment for the transmission signal and reception signal, respectively, based on these characteristics.

Based on the different frequency bands of the filter 14 and second reception filter 9, the transmitter section 60A can amplify the transmission signal for the receiver section 60B in terms of the mixed signal, and at the same time draw out the reception signal.

The detection circuit 10 implements the detection for the transmission monitor signal which is received through the filter 14 from the separator 8, and delivers the resulting DC signal to the gain controller 11A.

The controller 11, which is supplied with a prescribed control reference (output setting signal) from the outside and provided with a gain controller 11A, controls the gain amplifier 1 based on the control reference and the output of the separator 8.

Specifically, the control reference is provided by the base station for each local station, and the gain controller 11A controls the gain amplifier 1 such that in case the transmission output is to be 5 dB, the feedback signal from the receiver section 60B is adjusted to 5 dB, or in case the transmission output is to be 10 dB, the feedback signal is adjusted to 10 dB, for example.

In the transmission/reception apparatus 60 of this embodiment arranged as described above and shown in FIG. 1, the transmission signal is amplified by the gain amplifier 1 and next by the power amplifier 2 in the transmitter section 60A, and the transmission monitor signal is extracted by the transmission monitor signal extractor 3. The transmission monitor signal is coupled to the reception signal by the coupler 6 in the receiver section 60B, and it is separated by the separator 8 after being amplified by the low-noise amplifier 7.

The transmission monitor signal separated by the separator 8 is rendered the band confinment by the filter 14 and detected by the detection circuit 10 into a DC signal. A control voltage is produced from the DC signal from the detection circuit 10 and a prescribed control signal by the gain controller 11A, and it controls the gain amplifier 1.

Figure 2:
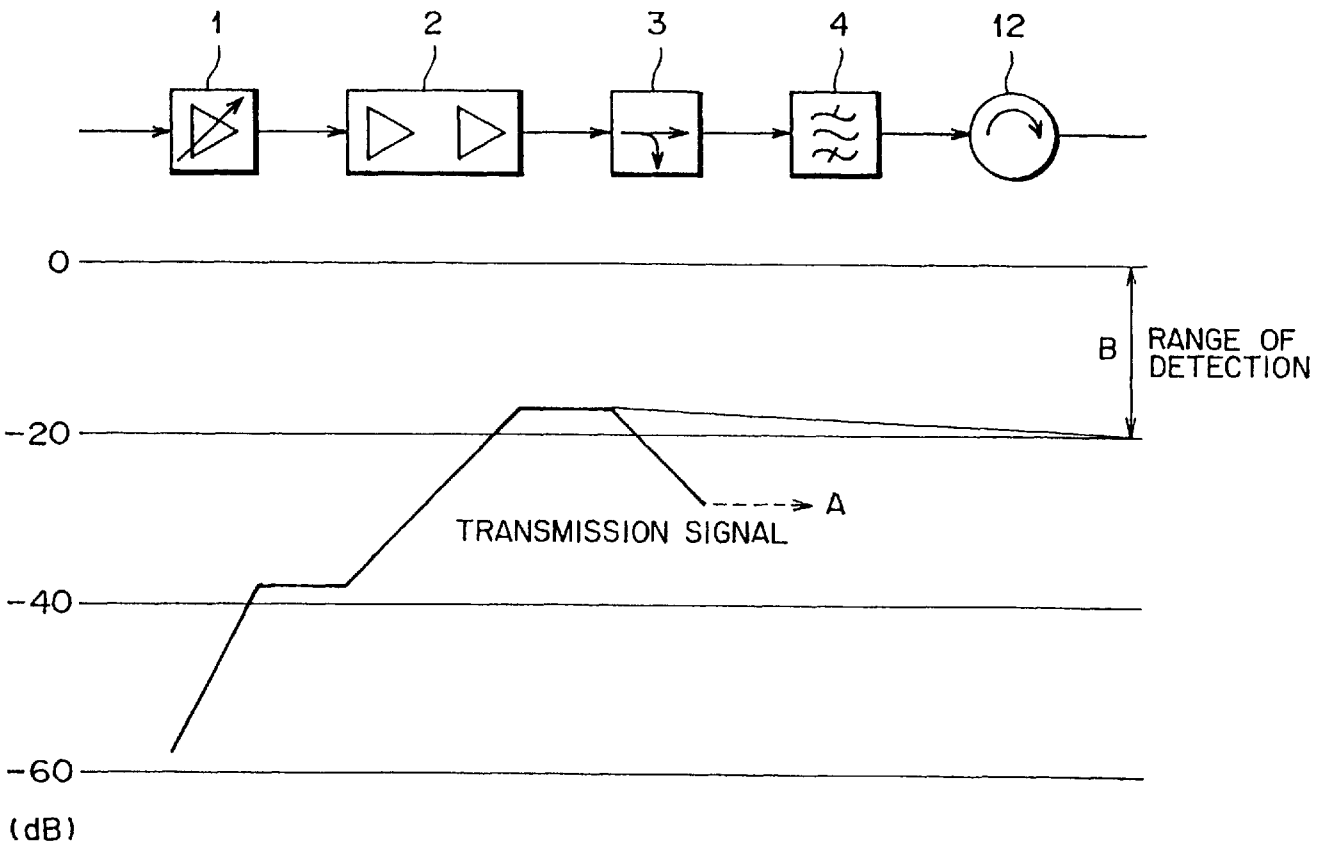
FIG. 2 is a diagram used to explain the transmission signal level in the transmitter section of the first embodiment.

In this case, if a transmission signal having a low output level of −60 dB, for example, is entered to the transmitter section 60A, the signal which is amplified by the gain amplifier 1 and power amplifier 2, with the transmission monitor signal for gain control being extracted from the signal by the transmission monitor signal extractor 3 (indicated by A in FIG. 2), and fed to the transmission filter 4 would go out of the range of detection (shown by B in FIG. 2).

Figure 3:
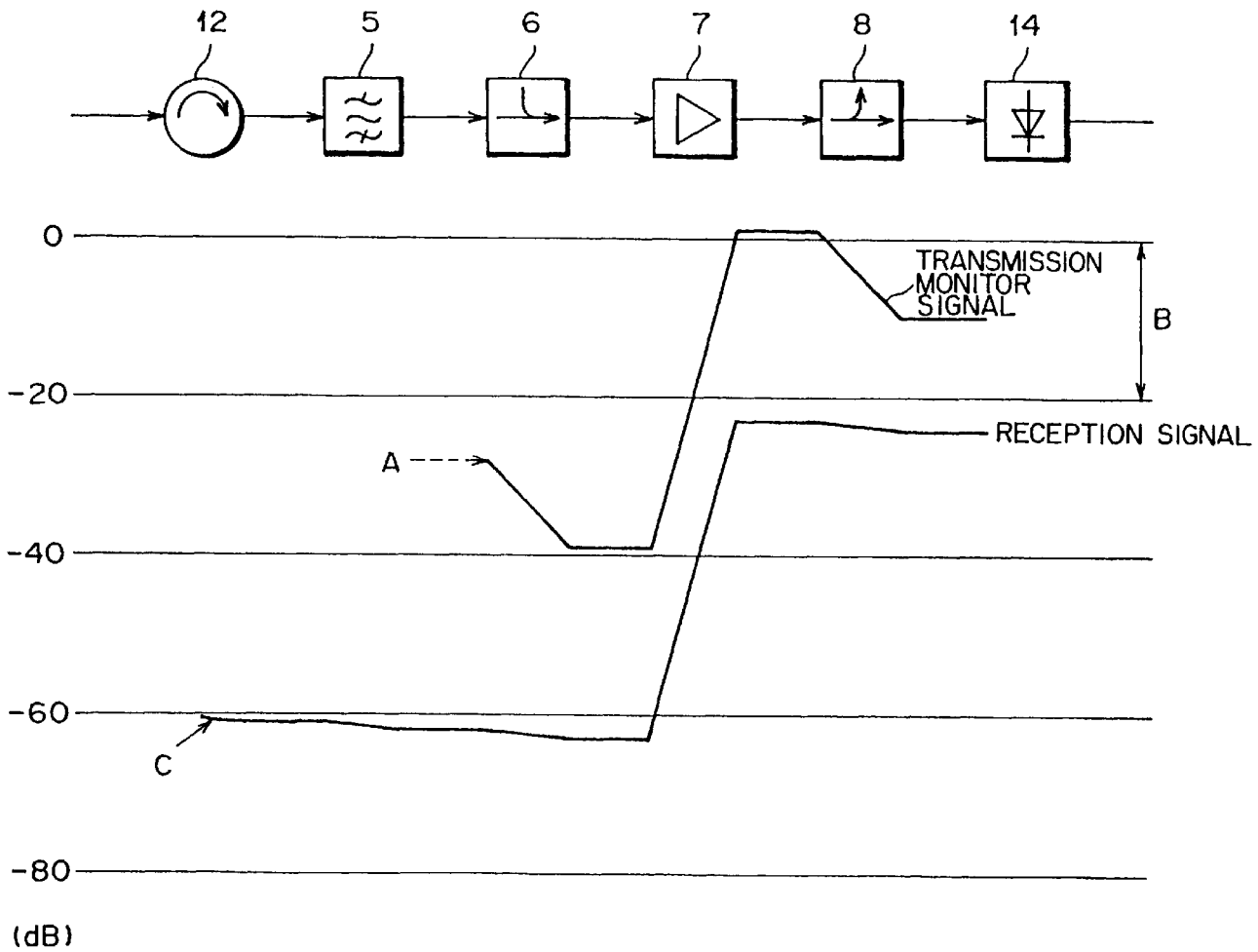
FIG. 3 is a diagram used to explain the transmission signal level in the receiver section of the first embodiment.

Instead, as shown in FIG. 3, the transmission monitor signal (shown by A) provided by the transmission monitor signal extractor 3 is received by the coupler 6 in the receiver section 60B and amplified by the low-noise amplifier 7 together with the reception signal (shown by C), causing the transmission monitor signal to have its level within the range of detection (shown by B).

Namely, a weak transmission signal is amplified in the receiver section 60B so that it can be treated for detection.

According to the transmission/reception apparatus 60 this embodiment, in which the transmission monitor signal extracted by the transmission monitor signal extractor 3 is fed back to the gain controller 11A by being amplified in the receiver section 60B, it becomes possible for the detection circuit 10 to have a sufficient input for detection even in the case of a low transmission signal level. Consequently, the transmission/reception apparatus 60 is capable of expanding the control range of transmission output, while minimizing the increase of the scale of circuit, and improving the processing ability significantly.

(b) Embodiment 2

Figure 5:
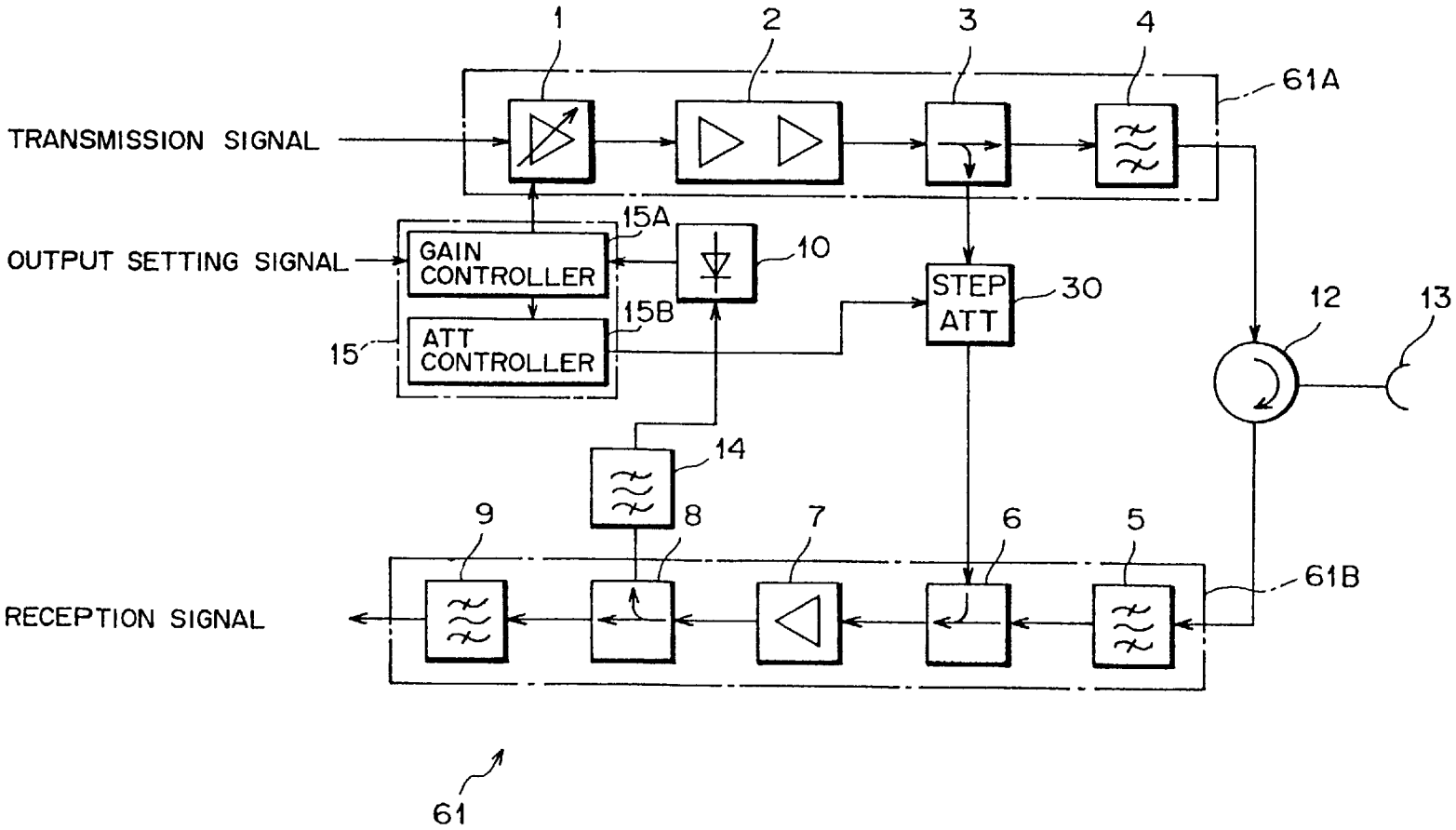
FIG. 5 is a block diagram showing the arrangement of the transmission/reception apparatus based on a second embodiment of this invention.

FIG. 5 shows the arrangement of the transmission/reception apparatus based on the second embodiment of this invention. In the figure, the transmission/reception apparatus 61 consists of a transmitter section 61A including a gain amplifier 1, power amplifier 2, transmission monitor signal extractor 3, and transmission filter 4, a receiver section 61B including a first reception filter 5, coupler 6, low-noise amplifier 7, separator 8, and second reception filter 9, a circulator 12, an antenna 13, a variable attenuator 30 connected between the transmission monitor signal extractor 3 and coupler 6, and a filter 14, detection circuit 10 and controller 15 connected in series between the separator 8 and gain amplifier 1.

The transmitter section 61A and receiver section 61B function identically to the counterparts 60A and 60B of the preceding embodiment, and detailed explanation thereof will be omitted. Some other circuit sections identical to those of the preceding embodiment are referred to by the common symbols, and detailed explanation thereof will be omitted. The transmission/reception apparatus 61 of this embodiment is derived from the first embodiment, with the variable attenuator 30 being inserted on the path between the transmission monitor signal extractor 3 and coupler 6.

The variable attenuator (STEP ATT) 30 renders stepped attenuation for the transmission monitor signal, which is extracted by the transmission monitor signal extractor 3, by being controlled by a variable attenuation controller 15B. The controller 15 consists of a gain controller 15A and variable attenuation (ATT) controller 15B, and it controls the gain amplifier 1 and variable attenuator 30 based on a control reference (output setting signal).

The gain controller 15A controls the gain amplifier 1 in accordance with the control reference and in response to the output of the separator 8. The attenuation controller 15B controls the degree of attenuation of the variable attenuator 30 depending on the transmission signal level. Specifically in this embodiment, the attenuation controller 15B sets the largest range of attenuation of the variable attenuator 30 in a first mode of high transmission signal level, sets the medium range of attenuation in a second mode of intermediate signal level, and sets the smallest range of attenuation in a third mode of low signal level.

Figure 6:
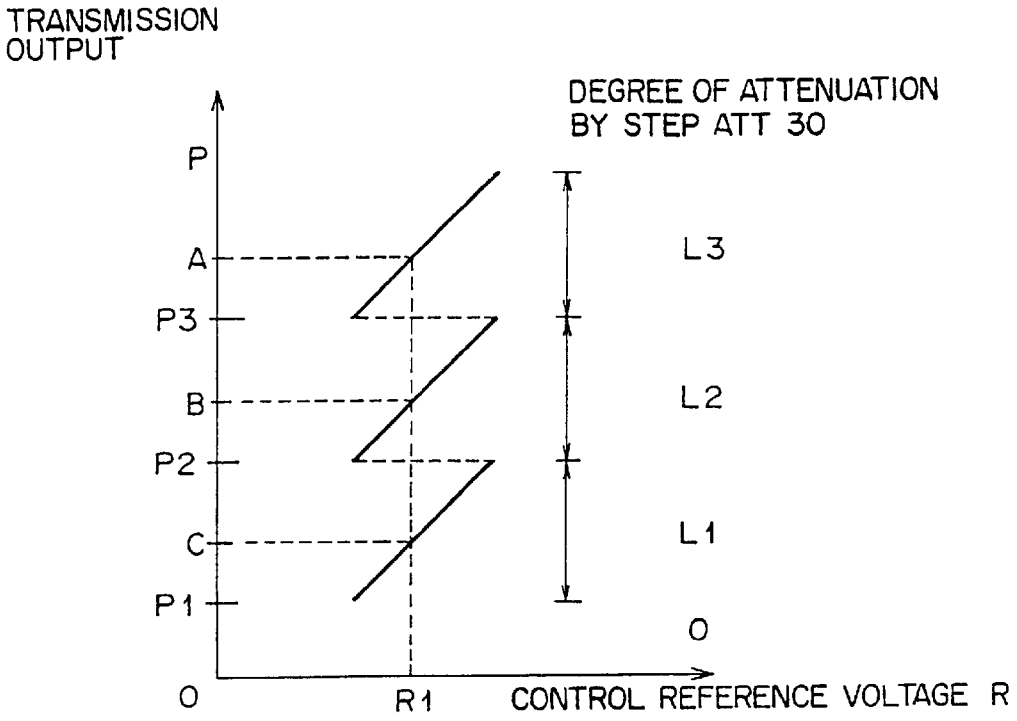
FIG. 6 is a diagram used to explain the degree of attenuation of the transmission monitor signal by the variable attenuator of the second embodiment.

FIG. 6 shows the setting of the degree of attenuation of the variable attenuator 30, in which for the first mode of a large transmission output P (e.g., P≧P3), the variable attenuator 30 is set to have the largest attenuation range L3 in accordance with the range switching signal provided by the attenuation controller 15B.

For the second mode of a medium transmission output P (e.g., P3>P>P2), the variable attenuator 30 is set to have the intermediate attenuation range L2 in accordance with the range switching signal provided by the attenuation controller 15B, and for the third mode of a small transmission output P (e.g., P≦P2), the variable attenuator 30 is set to have the smallest attenuation range L1 in accordance with the range switching signal provided by the attenuation controller 15B so that the attenuation is smallest or nullified. Namely, the setting of attenuation range is altered depending on the transmission signal level, thereby varying the degree of attenuation.

Namely, the attenuation controller 15B functions to set the larger attenuation range of the variable attenuator 30 for the first mode of high transmission signal level and set the smaller attenuation ranges of the variable attenuator 30 for the second and third modes of lower transmission signal levels.

The degree of attenuation within each range set by the attenuation controller 15B is further regulated in accordance with the control reference (reference voltage). For example, with the attenuation range being set to L3, the transmission output is regulated to A in proportion to the control reference (control reference voltage) having a value of R1, and in the cases of the attenuation ranges L2 and L1, the transmission outputs become B and C, respectively. Accordingly, this embodiment enables easy control of the degree of attenuation of the transmission monitor signal based on the switching of attenuation range, instead of making a wide-range alteration of the control reference.

Figure 7:
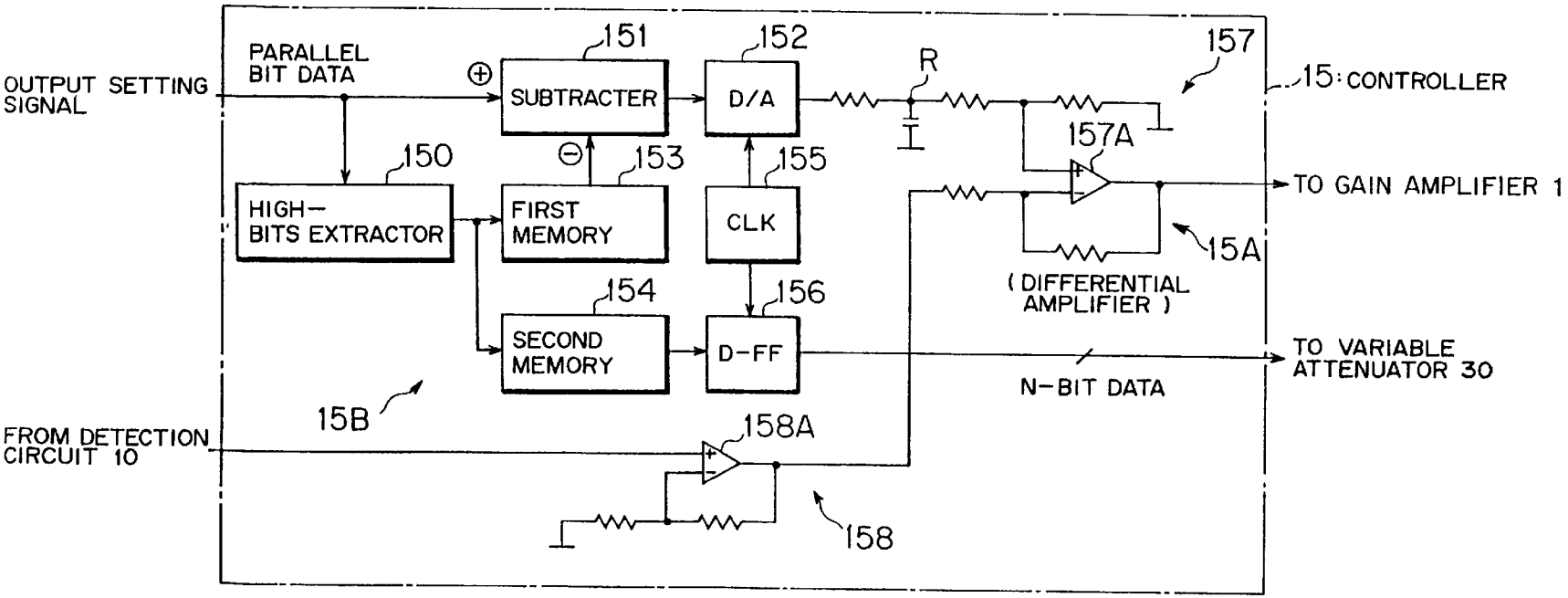
FIG. 7 is a block diagram showing the internal arrangement of the controller of the second embodiment.

For accomplishing the foregoing attenuation control of the variable attenuator 30, the controller 15 is arranged as shown in FIG. 7. The controller 15 includes a high-bits extractor 150, subtracter 151, D/A converter 152, first memory 153, second memory 154, clock generator (CLK) 155, latch circuit 156, and amplifiers 157 and 158.

Figure 8:
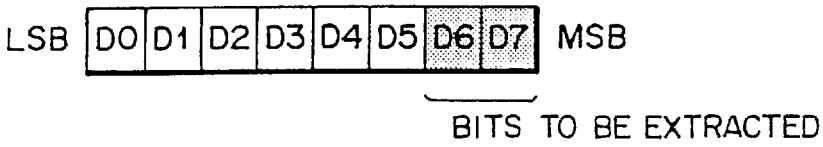
FIGS. 8(*a*) and 8(*b*) are diagrams used to explain the details of the controller of the second embodiment.
Figure 8:
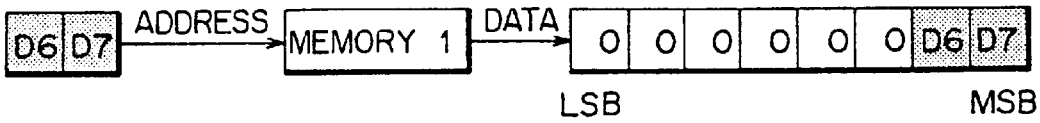

The high-bits extractor 150 takes a certain number of upper bits out of the control reference (this parallel-bit output setting signal will be called simply "control signal" hereinafter). For example, from an 8-bit control signal (D0,D1, . . . ,D7), the high-bits extractor 150 takes out upper two bits (D6,D7), as shown in FIG. 8(*a*).

The first memory 153 holds data of subtraction process of the subtracter 151. Specifically, it is addressed by the upper two bits (D6,D7) provided by the high-bits extractor 150 to release 8-bit data for subtraction having the two bits (D6,D7) for the upper bits, with the remaining lower bits being filled with "0"s, as shown in FIG. 8(*b*).

Figure 9:
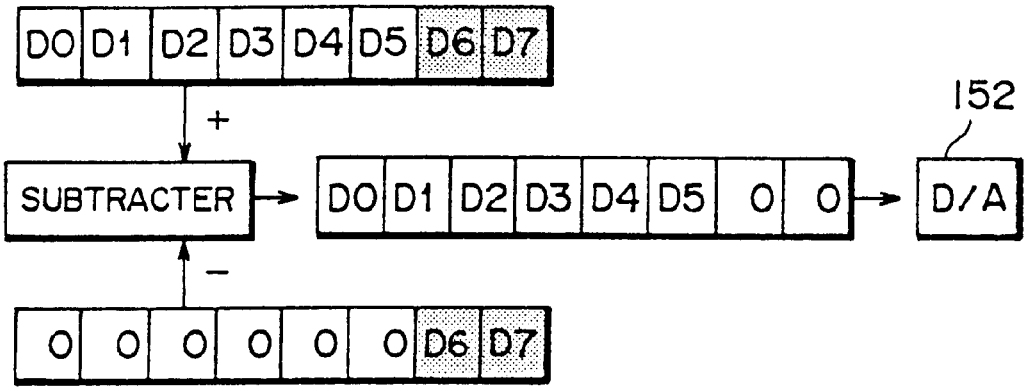
FIGS. 9(*a*) and 9(*b*) are diagrams used to explain the details of the controller of the second embodiment.

The subtracter 151 subtracts the data provided by the first memory 153 from the control signal, e.g., it subtracts 8-bit data (0,0, . . . 0,D6,D7) of 2-bit information from the 8-bit control signal (D0,D1, . . . ,D7) to produce (D0,D1, . . . ,D5,0,0) thereby removing the upper 2-bit information as shown in FIG. 9(*a*), and delivers the resulting data as reference information to the D/A converter 152, which will explained shortly.

The second memory 154 converts the data extracted by the high-bits extractor 150 into data used by the variable attenuator 30. For example, in case the variable attenuator 30 is programmed for setting in terms of 3-bit data (in 8 steps), the second memory 154 converts the upper two bits of the control signal: 00,01,10 or 11 into 000,010,100 or 110 for the variable attenuator 30 as shown in FIG. 9(*b*) so that it functions to attenuate the transmission monitor signal by 0 dB, 20 dB, 40 dB or 60 dB, respectively.

The D/A converter 152 shown in FIG. 7 converts the digital output data of the subtracter 151 into an analog signal. The clock generator 155 provides a clock signal (timing) for the D/A converter 152 and latch circuit 156. The latch circuit 156, which is a D-type flip-flop (D-FF), holds the data from the second memory 154 for a certain time length based on the clock signal provided by the clock generator 155, and it delivers the output as N-bit attenuation range switching data to the variable attenuator 30.

The amplifier 158, which is formed of an operational amplifier 158A, has its non-inverting (+) input supplied with the output of the detection circuit 10 and its inverting (−) input grounded, thereby amplifying the detection output.

The amplifier 157, which is formed of another operational amplifier 157A, has its non-inverting (+) input supplied with the output of the D/A converter 152 and its inverting (−) input supplied with the output of the amplifier 158, thereby operating as a differential amplifying circuit for producing an output which is proportional to the difference of these input signals.

Accordingly, the gain amplifier 1 is controlled by the control signal (control reference information) and the feedback transmission signal that has been rendered stepped attenuation, amplified in the receiver section 61B and detected by the detection circuit 10.

Figure 10:
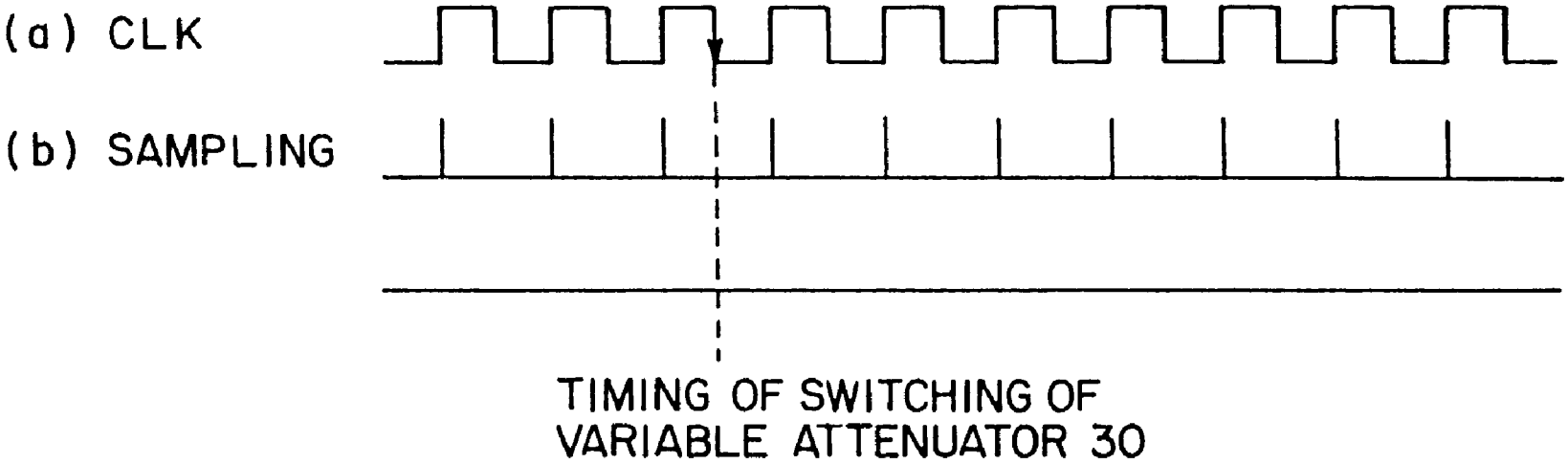
FIG. 10 is a diagram used to explain the timing of control of the gain controller and switching of the variable attenuator based on the second embodiment.

Gain control of the gain amplifier 1 by the gain controller 15A and range switching of the variable attenuator 30 by the attenuation controller 15B are timed to the sampling of the control signal as shown by (b) in FIG. 10 based on the reference clock shown by (a) provided by the clock generator 155, and consequently the transmission output control takes place smoothly.

According to the transmission/reception apparatus 61 of this embodiment, as shown in FIG. 5, the transmission signal is amplified by the gain amplifier 1 and next by the power amplifier 2 in the transmitter section 61A, and the transmission monitor signal is extracted by the transmission monitor signal extractor 3. The transmission monitor signal is attenuated by the variable attenuator 30 at a certain degree of attenuation in accordance with the attenuation range switching signal produced by the attenuation controller 15B shown in FIG. 7, i.e., specifically, the variable attenuator 30 has the largest degree of attenuation in the first mode of high transmission signal level, the medium degree of attenuation in the second mode of lower signal level, and the smallest degree of attenuation in the third mode of much lower signal level.

The signal which has been subjected to variable attenuation control by the variable attenuator 30 is coupled to the reception signal by the coupler 6 in the receiver section 61B, and it is separated by the separator 8 after being amplified by the low-noise amplifier 7. The transmission monitor signal separated by the separator 8 is rendered the band confinment by the filter 14 and detected by the detection circuit 10 into a DC signal.

The gain controller 15A controls the gain of the gain amplifier 1 in accordance with the DC signal from the detection circuit 10 and the control signal, and at the same time the attenuation controller 15B controls the degree of attenuation of the variable attenuator 30 based on these signals.

Namely, the transmission/reception apparatus 61 has the provision of the variable attenuator 30 located between the transmission monitor signal extractor 3 and coupler 6 so that it is switched to have the largest degree of attenuation in the first mode of high transmission signal level, the medium degree of attenuation in the second mode of lower signal level, and the smallest degree of attenuation in the third mode of much lower signal level, whereby it is capable of expanding the control range of transmission output, while minimizing the increase of the scale of circuit, and making the amplifying process of the receiver section 61B efficient.

The number of modes (steps) of the variable attenuator 30 may be switched to be 2, 4 or more depending on the degree of attenuation of the transmission signal, instead of 3 of the foregoing embodiment, or it can even be variable for the sake of flexible system organization.

(c) Embodiment 3

Figure 11:
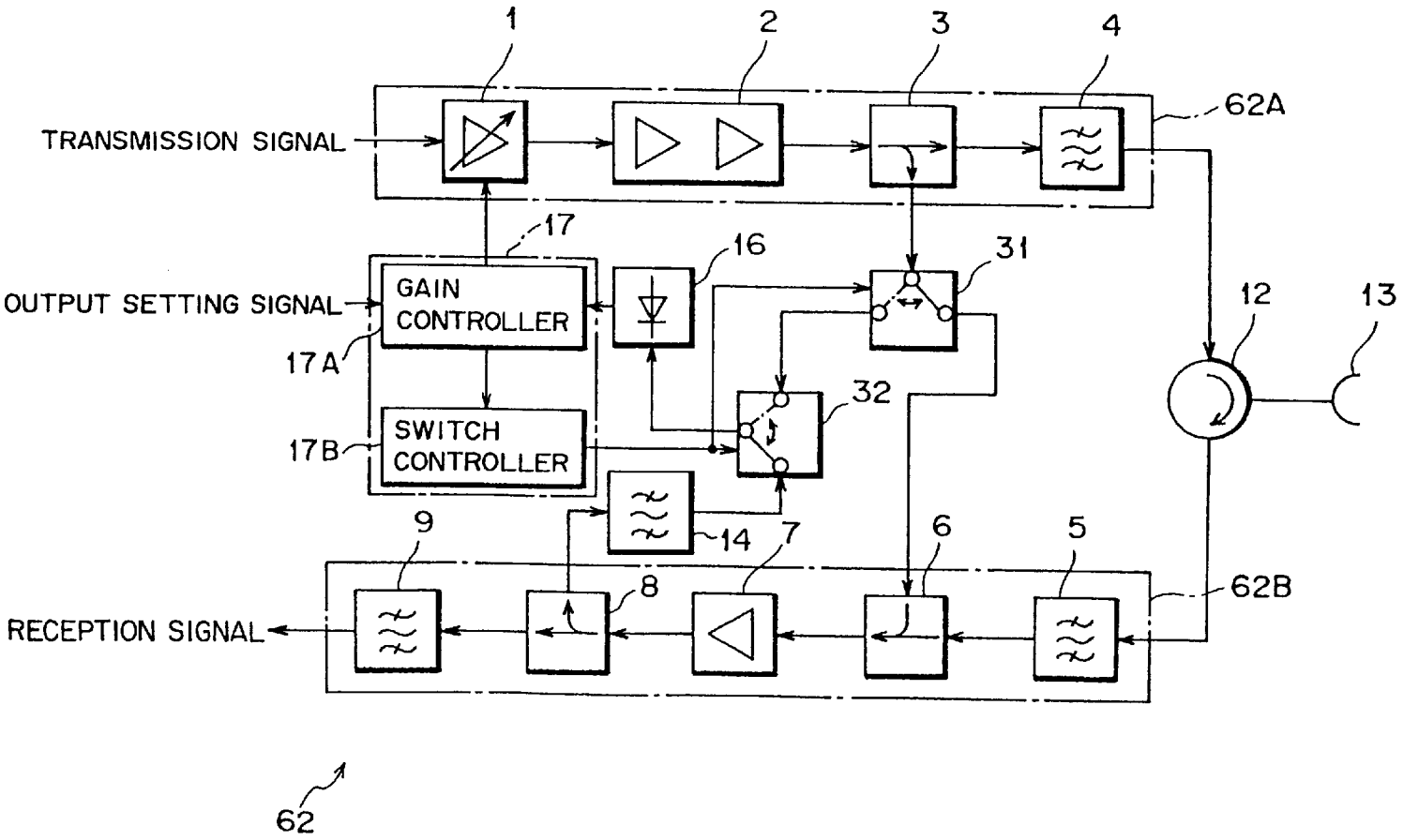
FIG. 11 is a block diagram showing the arrangement of the transmission/reception apparatus based on a third embodiment of this invention.

FIG. 11 shows the arrangement of the transmission/reception apparatus based on the third embodiment of this invention. In the figure, the transmission/reception apparatus 62 consists of a transmitter section 62A including a gain amplifier 1, power amplifier 2, transmission monitor signal extractor 3, and transmission filter 4, a receiver section 62B including a first reception filter 5, coupler 6, low-noise amplifier 7, separator 8, and second reception filter 9, a circulator 12, an antenna 13, a first selector switch 31 which connects the transmission monitor signal extractor 3 to the coupler 6, and a filter 14, second selector switch 32, detection circuit 16 and controller 17 connected in series between the separator 8 and gain amplifier 1.

The transmitter section 62A and receiver section 62B function identically to the counterparts 60A and 60B of the first embodiment, and detailed explanation thereof will be omitted. Some other circuit sections identical to those of the preceding embodiments are referred to by the common symbols, and detailed explanation thereof will be omitted.

The transmission/reception apparatus 62 of this embodiment is derived from the first embodiment, with the first selector switch 31 and second selector switch 32 being inserted on the paths between the transmission monitor signal extractor 3 and coupler 6 and between the separator 8 and a gain controller 17A which will be explained shortly, respectively.

The first selector switch 31, which is formed of a high-frequency switch such as a PIN diode, is controlled by a switch controller 17B which will be explained shortly to sample the transmission monitor signal provided by the transmission monitor signal extractor 3 depending on the transmission signal level. The second selector switch 32, which is formed of a high-frequency switch such as a PIN diode, is controlled by the switch controller 17B to direct selectively the output of the separator 8 or the output of the first selector switch 31 to the gain controller 17A.

The detection circuit 16 implements the detection for the output signal of the second selector switch 32, and the controller 17 including the gain controller 17A and switch controller 17B controls the gain amplifier 1, first selector switch 31 and second selector switch 32 based on a prescribed control reference (output setting signal).

The gain controller 17A, which is supplied with the control reference, controls the gain amplifier 1 in accordance with the control reference and the output of the second selector switch 32. The switch controller 17B controls the switching of the first selector switch 31 and second selector switch 32 depending on the transmission signal level, and it operates the first selector switch 31 to have its output directed to the input of the second selector switch 32 and operates the second selector switch 32 to have its input receiving the output of the first selector switch 31 in a first mode of high transmission signal level, while it operates the first selector switch 31 to have its output directed to the coupler 6 and operates the second selector switch 32 to have its input receiving the output of the separator 8 in a second mode of low transmission signal level.

Figure 12:
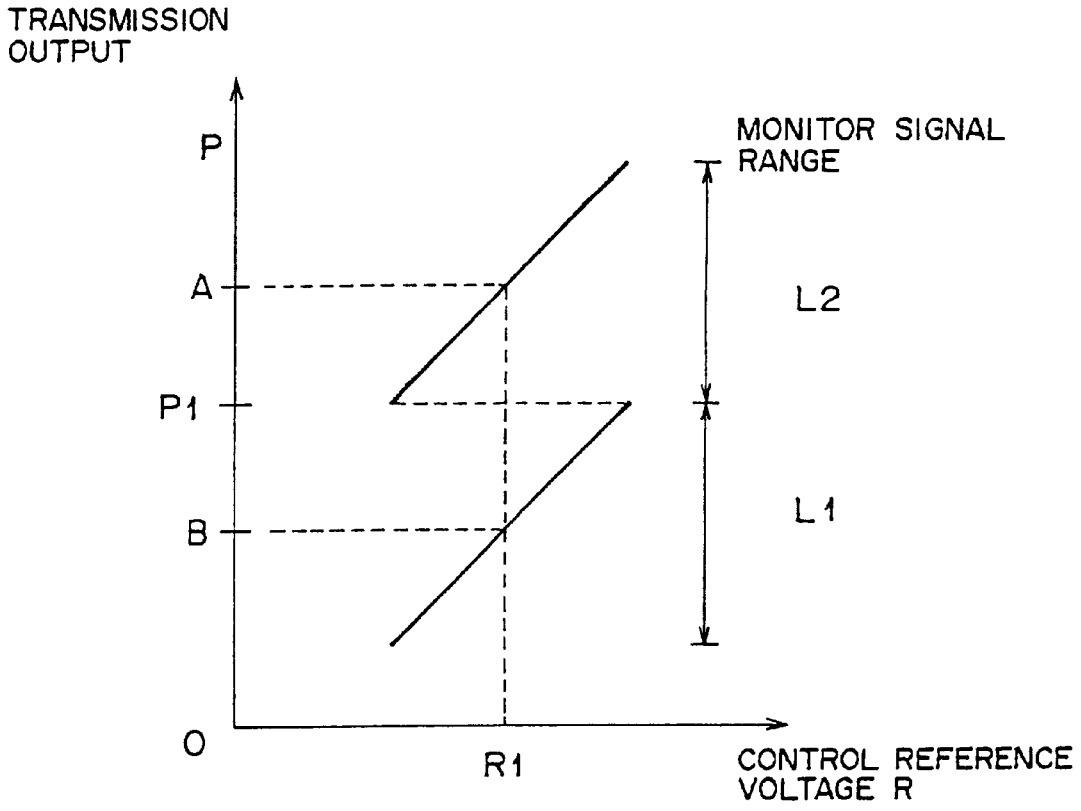
FIG. 12 is a diagram used to explain the transmission monitor signals provided by the first and second selector switches of the third embodiment.

Specifically, as shown in FIG. 12, in the first mode of a large transmission output P (e.g., P>P1), the first selector switch 31 and second selector switch 32 are set to have a feedback range L2 in response to the switching signal from the switch controller 17B so that the first selector switch 31 has its output directed to the input of the second selector switch 32 and the second selector switch 32 has its input receiving the output of the first selector switch 31.

In the second mode of a small transmission output P (e.g., P≦P1), the first selector switch 31 and second selector switch 32 are set to have a feedback range L1 in response to the switching signal from the switch controller 17B so that the first selector switch 31 has its output directed to the coupler 6 and the second selector switch 32 has its input receiving the output of the separator 8.

Accordingly, the transmission output is fed back to the gain amplifier 1 by jumping the receiver section 62B when it is larger than P1, or fed back to the gain amplifier 1 by being fed through the receiver section 62B for amplification when it is at P1 or smaller. In this manner, the feedback range is altered depending on the transmission signal level.

The feedback transmission output within each feedback range is further regulated in accordance with the control reference (reference voltage). For example, with the feedback range being set to L2, the transmission output is regulated to A in proportion to reference voltage R1, and for the feedback range L1, the feedback transmission output becomes B, as shown in FIG. 12. Accordingly, this embodiment enables easy control of the transmission monitor signal based on the switching of feedback range, instead of making a wide-range alteration of the control reference voltage.

Figure 13:
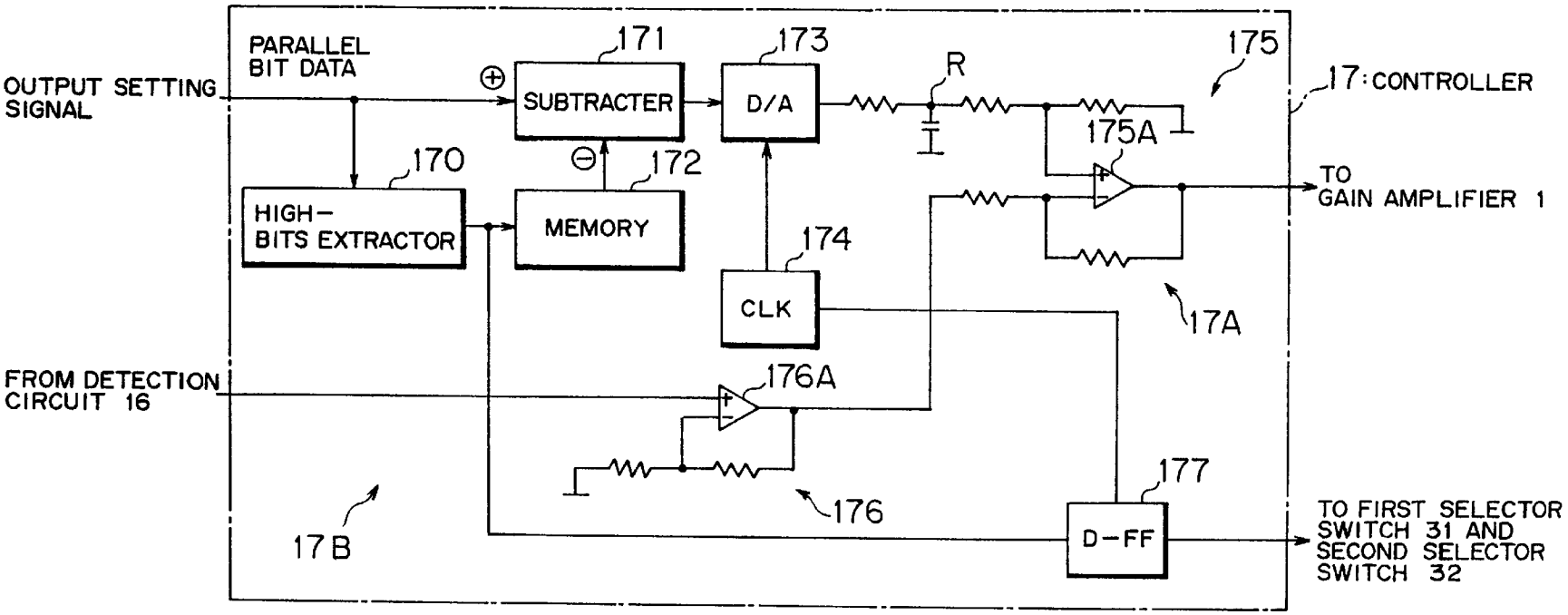
FIG. 13 is a block diagram showing the internal arrangement of the controller of the third embodiment.

For accomplishing the foregoing switching control of the first selector switch 31 and second selector switch 32, the controller 17 is arranged as shown in FIG. 13. The controller 17 includes a high-bits extractor 170, subtracter 171, memory 172, D/A converter 173, clock generator (CLK) 174, amplifiers 175 and 176, and latch circuit 177.

The high-bits extractor 170, subtracter 171, memory 172, D/A converter 173, clock generator 174 and amplifier 175 and 176 all function identically to the high-bits extractor 150, subtracter 151, first memory 153, D/A converter 152, clock generator 155 and amplifier 157 and 158, and their detailed explanation will be omitted.

The latch circuit (D-FF) 177, which is a D-type flip-flop, holds the upper 2-bit data provided by the high-bits extractor 170 for a certain time length based on the clock signal provided by the clock generator 174, and it releases the output as the switching signal to the first selector switch 31 and second selector switch 32.

Gain control of the gain amplifier 1 by the gain controller 17A and range switching of the first selector switch 31 and second selector switch 32 by the switch controller 17B are timed to the sampling of the control signal based on the reference clock provided by the clock generator 174 in the same manner as the second embodiment, and consequently the transmission output control takes place smoothly.

According to the transmission/reception apparatus 62 of this embodiment, the transmission signal is amplified by the gain amplifier 1 and next by the power amplifier 2 in the transmitter section 62A, and the transmission monitor signal is extracted by the transmission monitor signal extractor 3. The transmission monitor signal is treated in response to the switching signal provided by the switch controller 17B shown in FIG. 13. Specifically, in the first mode of high transmission signal level, the first selector switch 31 has its output directed to the second selector switch 32 and thereafter the second selector switch 32 is switched to receive the output of the first selector switch 31, and the resulting transmission monitor signal is detected into a DC signal by the detection circuit 16.

The gain controller 17A controls the gain amplifier 1 in accordance with the DC signal and control signal, and at the same time the switch controller 17B operates the first selector switch 31 and second selector switch 32 based on these signals.

In the second mode of low transmission signal level, the first selector switch 31 has its output directed to the coupler 6 of the receiver section 62B so that it is coupled to the reception signal, amplified by the low-noise amplifier 7 and separated by the separator 8. The separated transmission monitor signal is rendered the band confinment by the filter 14, directed by the second selector switch 32, which is switched to receive the filter output, to the detection circuit 16, by which the monitor signal is detected into a DC signal.

The gain controller 17A controls the gain amplifier 1 in accordance with the DC signal and control signal, and at the same time the switch controller 17B operates the first selector switch 31 and second selector switch 32 based on these signals.

Namely, the transmission/reception apparatus 62 has the provision of the first selector switch 31 and second selector switch 32 located between the transmission monitor signal extractor 3 and coupler 6 and between the separator 8 and gain controller 17A, respectively, so that the transmission signal is fed back to the gain controller 17A by jumping the receiver section 62B in the first mode of high transmission signal level, or the transmission signal is fed back to the gain controller 17A by being amplified in the receiver section 62B in the second mode of low transmission signal level and in need of amplification, whereby it is capable of expanding the control range of the transmission output, while minimizing the increase of the scale of circuit, and minimizing the power consumption of the receiver section 62B, and it contributes significantly to the flexible system organization.

(d) Embodiment 4

Figure 14:
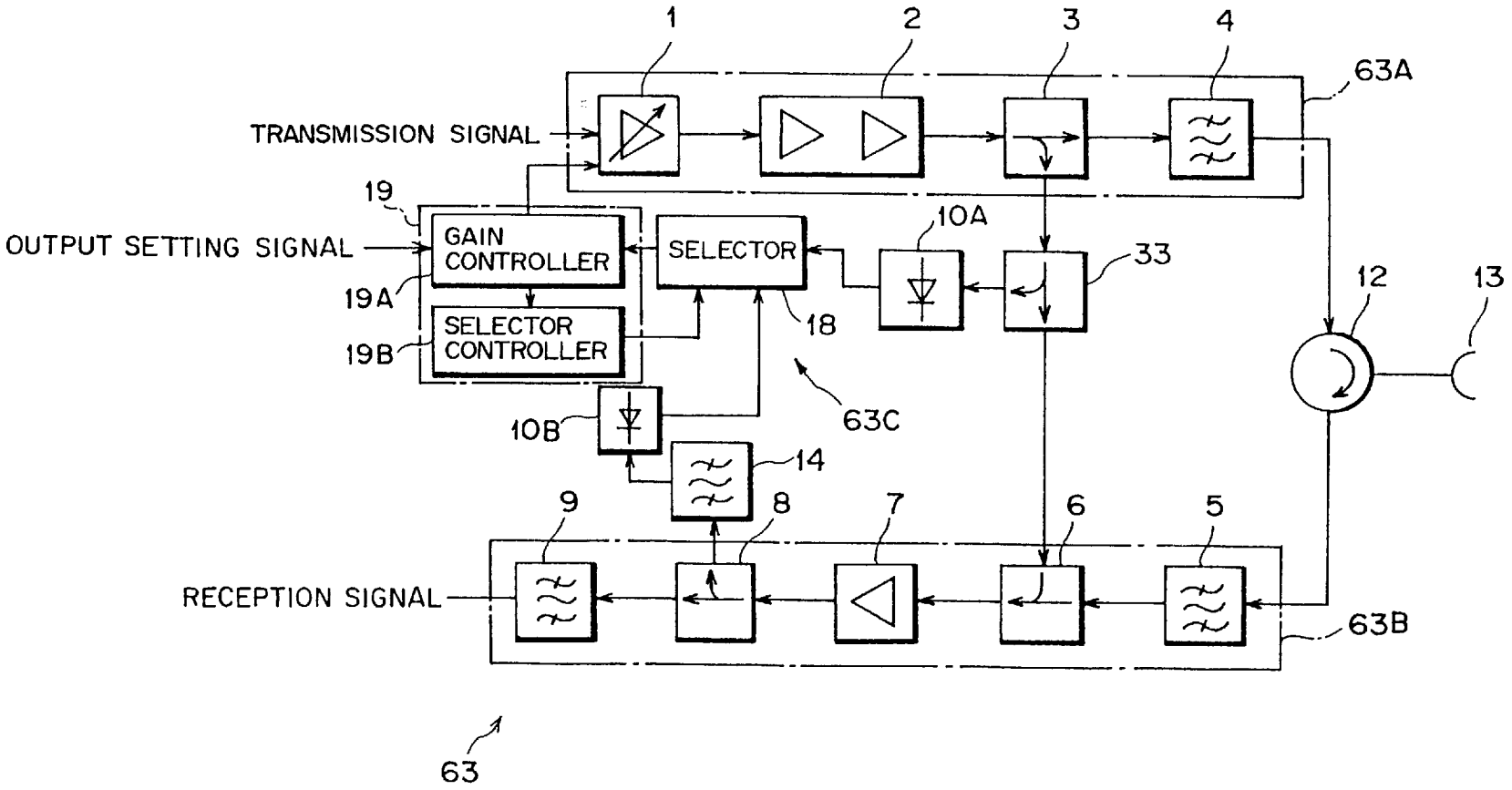
FIG. 14 is a block diagram showing the arrangement of the transmission/reception apparatus based on a fourth embodiment of this invention.

FIG. 14 shows the arrangement of the transmission/reception apparatus based on the fourth embodiment of this invention. In the figure, the transmission/reception apparatus 63 consists of a tranmitter section 63A including a gain amplifier 1, power amplifier 2, transmission monitor signal extractor 3, and transmission filter 4, a receiver section 63B including a first reception filter 5, coupler 6, low-noise amplifier 7, separator 8, and second reception filter 9, a circulator 12, an antenna 13, a distributor 33 inspected on the path between the transmission monitor signal extractor 3 and coupler 6, a filter 14, second detection circuit 10B, selector 18 and controller 19 connected in series between the separator 8 and gain amplifier 1, and a first detection circuit 10A connected between the distributor 33 and selector 18.

The transmitter section 63A and receiver section 63B function identically to the counterparts 60A and 60B of the first embodiment, and detailed explanation thereof will be omitted. Some other circuit sections identical to those of the preceding embodiments are referred to by the common symbols, and detailed explanation thereof will be omitted. The transmission/reception apparatus 63 of this embodiment is derived from the first embodiment, with the distributor 33 and selector 18 being connected between the transmission monitor signal extractor 3 and coupler 6 and between the separator 8 and a gain controller 19A which will be explained shortly, respectively.

In the case of an attenuated transmission signal level, the distributor 33 distributes the value of transmission monitor signal extracted by the transmission monitor signal extractor 3 in a prescribed proportion in two ways depending on the transmission signal level [about 10 dB (or 1/10 of transmission output) in the example shown by A in FIG. 2]. For example, 1/10 of the extracted transmission signal level is fed to the first detection circuit 10A and most of the rest (about 9/10 level) is fed to the coupler 6, i.e., the first detection circuit 10A receives 20 dB and the coupler 6 receives 10 dB.

The selector 18 supplies selectively the output of the separator 8 or the output of the distributor 33 to the gain controller 19A which will be explained shortly. The detection circuit 10A implements the detection for the output of the distributor 33, and another detection circuit 10B detects the output of the filter 14.

The controller 19, which includes the gain controller 19A and a selection (SEL) controller 19B, controls the gain amplifier 1 and selector 18 based on a prescribed control reference (output setting signal).

The gain controller 19A, which is supplied with the control reference, controls the gain amplifier 1 in accordance with the control reference and the output of the selector 18. The selection controller 19B controls the selector 18 depending on the transmission signal level. Specifically, it operates the selector 18 to select the output of the distributor 33 in a first mode of high transmission signal level, or select the output of the separator 8 in a second mode of low signal level.

Figure 15:
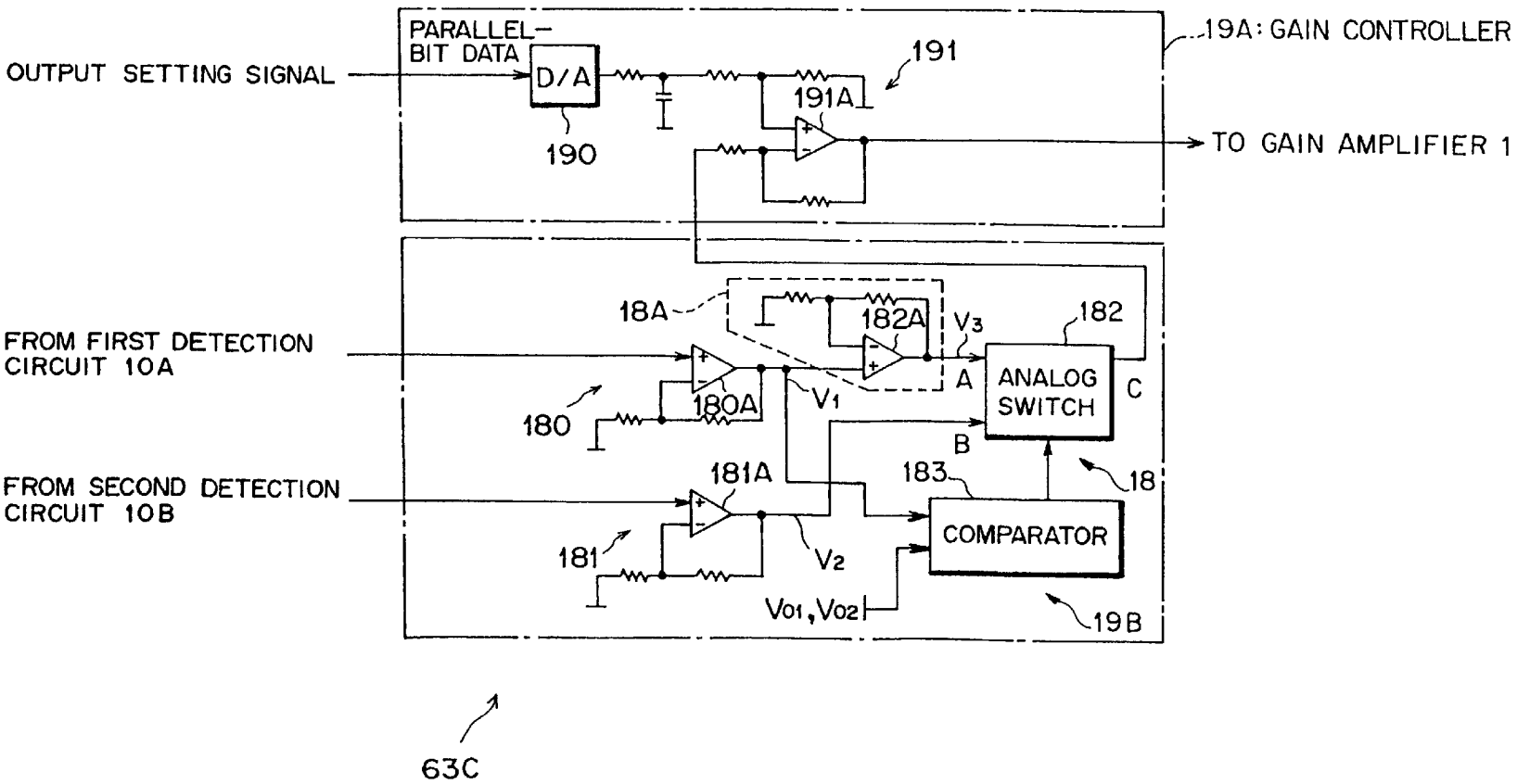
FIG. 15 is a block diagram showing the internal arrangement of the selection control system of the fourth embodiment.

FIG. 15 shows the arrangement of the selection control system of the transmission/reception apparatus 63. The selection control system 63C consists of the gain controller 19A including a D/A converter 190 and amplifier 191, the selector 18 including amplifiers 180, 181 and 18A and analog switch 182, and the selection controller 19B including a comparator 183.

The D/A converter 190 converts parallel-bit data (output setting signal) sent from the base station into an analog signal. The amplifier 191, which is formed of an operational amplifier 191A, has its non-inverting (+) input supplied with the output of the D/A converter 190 and its inverting (−) input supplied with the output of the analog switch 182, thereby operating as a differential amplifying circuit for producing an output which is proportional to the difference of these input signals. The output of the amplifier 191 controls the gain amplifier 1.

The amplifier 180, which is formed of an operational amplifier 180A, has its non-inverting (+) input supplied with the output of the first detection circuit 10A and its inverting (−) input grounded, thereby amplifying the detection output of 10A.

The amplifier 181, which is formed of an operational amplifier 181A, has its non-inverting (+) input supplied with the output of the second detection circuit 10B and its inverting (−) input grounded, thereby amplifying the detection output of 10B.

The amplifier 18A, which is formed of an operational amplifier 182A, has its non-inverting (+) input supplied with the output (V1) of the amplifier 180 and its inverting (−) input grounded, thereby amplifying the output V1.

The comparator 183 compares the output (V1) of the amplifier 180 with preset reference voltages Vo1 and Vo2, and controls the below-mentioned analog switch 182 based on the comparison result. The analog switch 182 selects the output (V3 on input terminal A) of the amplifier 18A or the output (V2 on input terminal B) of the amplifier 181 in accordance with the output of the comparator 183, and delivers the output (on output terminal C) to the inverting (−) input of the amplifier 191.

Namely, the amplifiers 180 and 181 have different output levels of V1 and V2, i.e., the latter derived from the amplification by the receiver section 63B represents a smaller transmission output, and on this account the amplifier 18A adjusts the output level of the amplifier 180 so that the V1 and V2 have a common reference output level.

Figure 16:
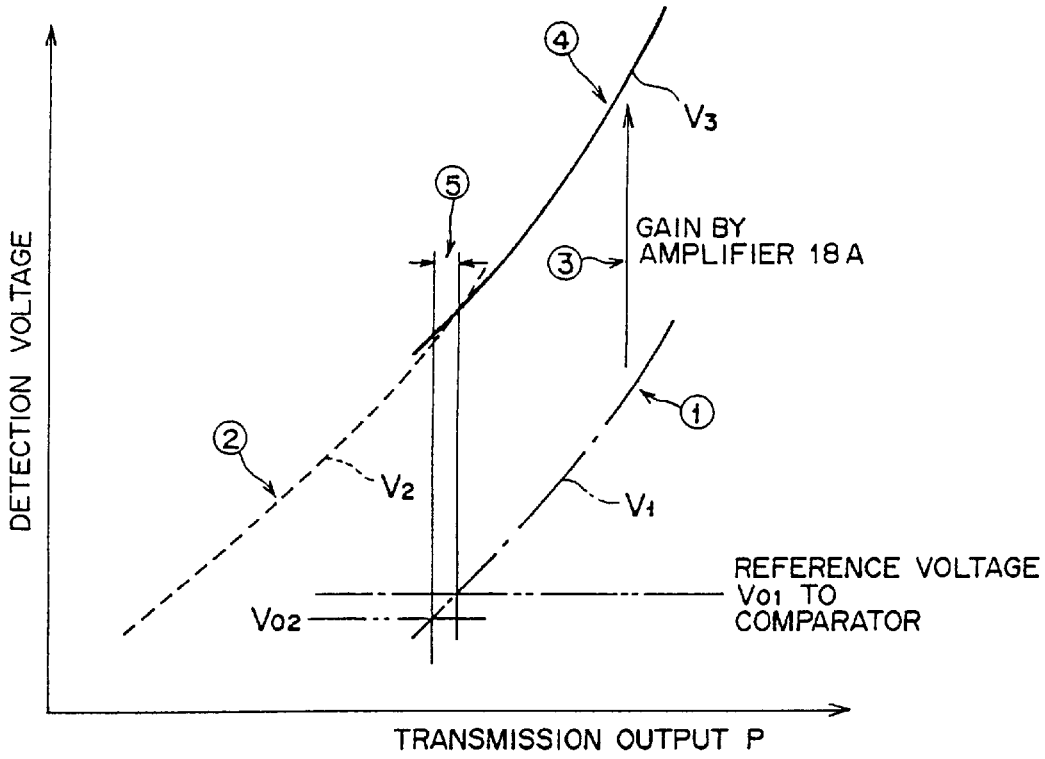
FIG. 16 is a diagram used to explain the transmission output level produced by the controller of the fourth embodiment.

Specifically, as shown in FIG. 16, the voltage V1 (indicated by ① and the voltage V2 (indicated by ②) represent different transmission signal levels (transmission outputs P) for their input voltages (detection voltages) provided by the first and second detection circuits 10A and 10B, and V1 is amplified by the amplifier 18A (indicated by ③) so that the V1 curve is shifted to V3 (indicated by ④) and is virtually continual to the V2 curve. Consequently, the selection control system has a wide range of detection voltage, enabling wide-range transmission output control.

The switching of the V1 and V2 curves is controlled based on the reference voltages Vo1 and Vo2 supplied to the comparator 183. As shown in FIG 17, when V1 is higher than Vo1, the analog switch 182 is operated to select the input from the amplifier 18A (conduction of input terminal A to output terminal C), and the transmission output is evaluated based on the V3 curve (indicated by ④) in FIG. 16.

When V1 is between Vo1 and Vo2, the comparator 183 operates the analog switch 182 depending on the value of V1, i. e., when V1 is close to Vo1, the analog switch 182 selects the input from the amplifier 18A (conduction of input terminal A to output terminal C). When V1 reaches Vo2, the analog switch 182 is operated to select the input from the amplifier 181 (conduction of input terminal B to output terminal C). Namely, the voltage V1 has a hysteresis switching zone (indicated by ⑤ in FIG. 16) between the reference voltages Vo1 and Vo2, thereby preventing the occurrence of hunting and stabilizing the switching operation in this zone.

When V1 is lower than Vo2, the analog switch 182 is operated to select the input from the amplifier 181 (conduction of input terminal B to output terminal C), and the transmission output is evaluated based on the V2 curve (indicated by ②) in FIG. 16.

Namely, the analog switch 182 is designed to select the larger of the two outputs of the distributor 33 based on one output (output of the first detection circuit 10A amplified by the amplifier 180) and the reference voltages Vo1 and Vo2 set on the comparator 183, and the gain controller 19A responds to the resulting transmission monitor signal to control the gain amplifier 1.

According to the transmission/reception apparatus 63 of this embodiment, the transmission signal is amplified by the gain amplifier 1 and next by the power amplifier 2 in the transmitter section 63A, and the transmission monitor signal is extracted by the transmission monitor signal extractor 3, as shown in FIG. 14. The transmission monitor signal is divided by the distributor 33 and fed to the first detection circuit 10A and coupler 6.

One output of the distributor 33 is detected by the first detection circuit 10A, and the resulting DC signal is fed to the selector 18. Another output of the distributor 33 is coupled to the reception signal by the coupler 6, amplified by the low-noise amplifier 7 and separated by the separator 8. The separated transmission monitor signal is rendered the band confinment by the filter 14, detected by the second detection circuit 10B, and the resulting DC signal is fed to the selector 18.

The selector 18 selects the output of the first detection circuit 10A or the output of the second detection circuit 10B as explained in connection with FIG. 15. The gain controller 19A receives the output of the selector 18 and a prescribed control reference and controls the gain amplifier 1, and the selection controller 19B controls the selector 18 based on these signals.

Namely, the transmission/reception apparatus 63 has the provision of the distributor 33 and selector 18 located between the transmission monitor signal extractor 3 and coupler 6 and between the separator 8 and gain controller 19A, respectively, so that the monitor signal from the distributor 33 is selected by the selector 18 and fed back to the gain controller 19A by jumping the receiver section 63B in the first mode of high transmission signal level, or the monitor signal by way of the separator 8 is selected by the selector 18 and fed back to the gain controller 19A by being amplified in the receiver section 63B in the second mode of low transmission signal level, whereby it is capable of expanding the control range of the transmission output, while minimizing the increase of the scale of circuit, and selecting the high-quality transmission monitor signal, and it contributes significantly to the enhancement of performance of the apparatus.

(e) Embodiment 5

Figure 18:
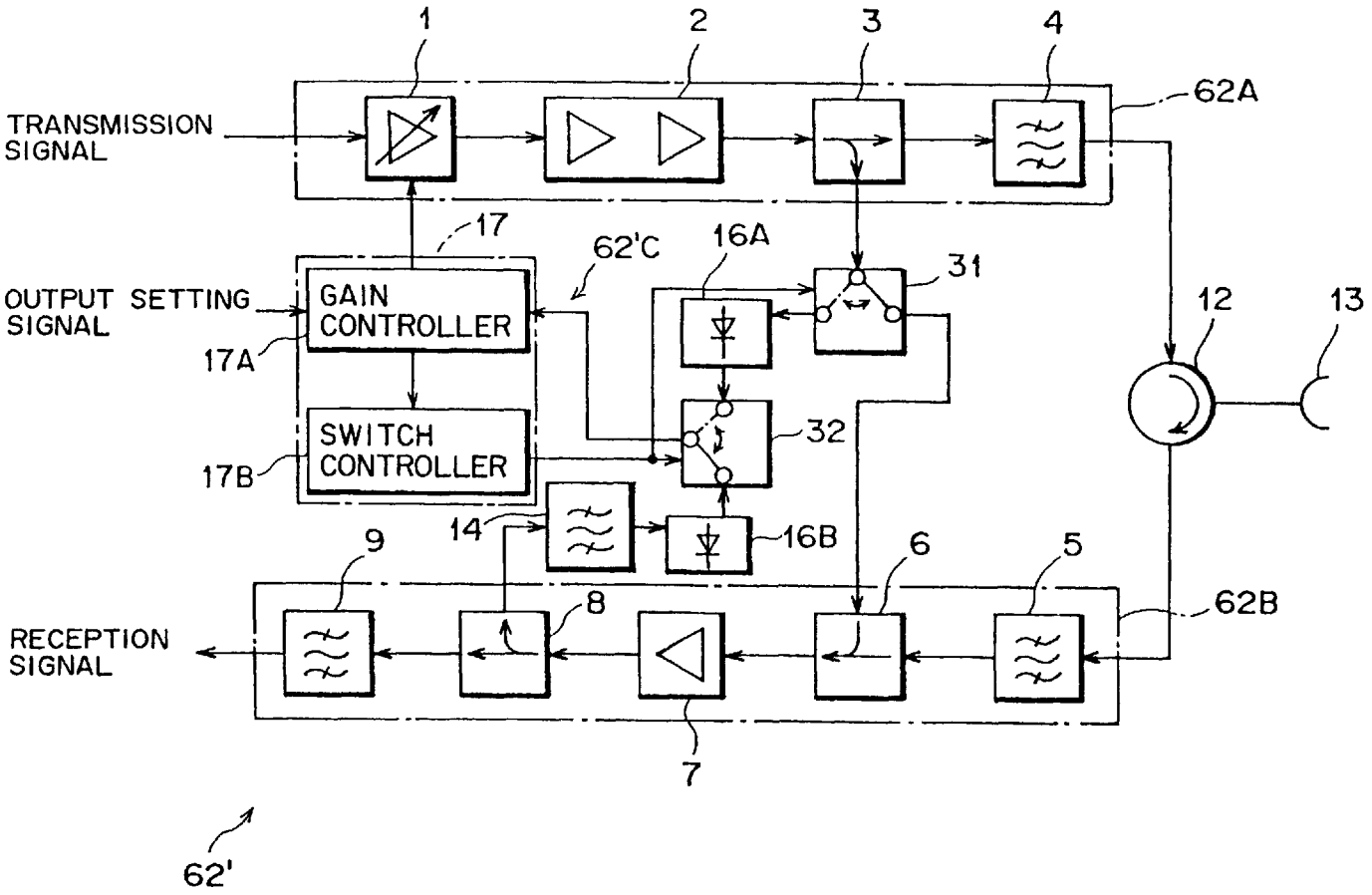
FIG. 18 is a block diagram showing the arrangement of the transmission/reception apparatus based on a fifth embodiment of this invention.

The transmission/reception apparatus 62 of the preceding third embodiment, in which the detection circuit 16 is connected at the output of the second selector switch 32, can be modified to include detection circuits (first detection circuit 16A and second detection circuit 16B) connected at the input of the second selector switch 32 as shown in FIG. 18 as a transmission/reception apparatus 62'. In the figure, circuit sections identical to those of the preceding embodiments are referred to by the common symbols, and detailed explanation thereof will be omitted.

The transmission/reception apparatus 62' of this embodiment has its second selector switch 32 formed of a low-frequency analog switch thereby to configure a selection control system 62' C. similar to the selection control system 63C of the fourth embodiment. Namely, the transmission/reception apparatus 62' of this embodiment is derived from the apparatus 62 of the third embodiment, with its controller 17 being replaced with the controller 19 of the fourth embodiment.

Figure 19:
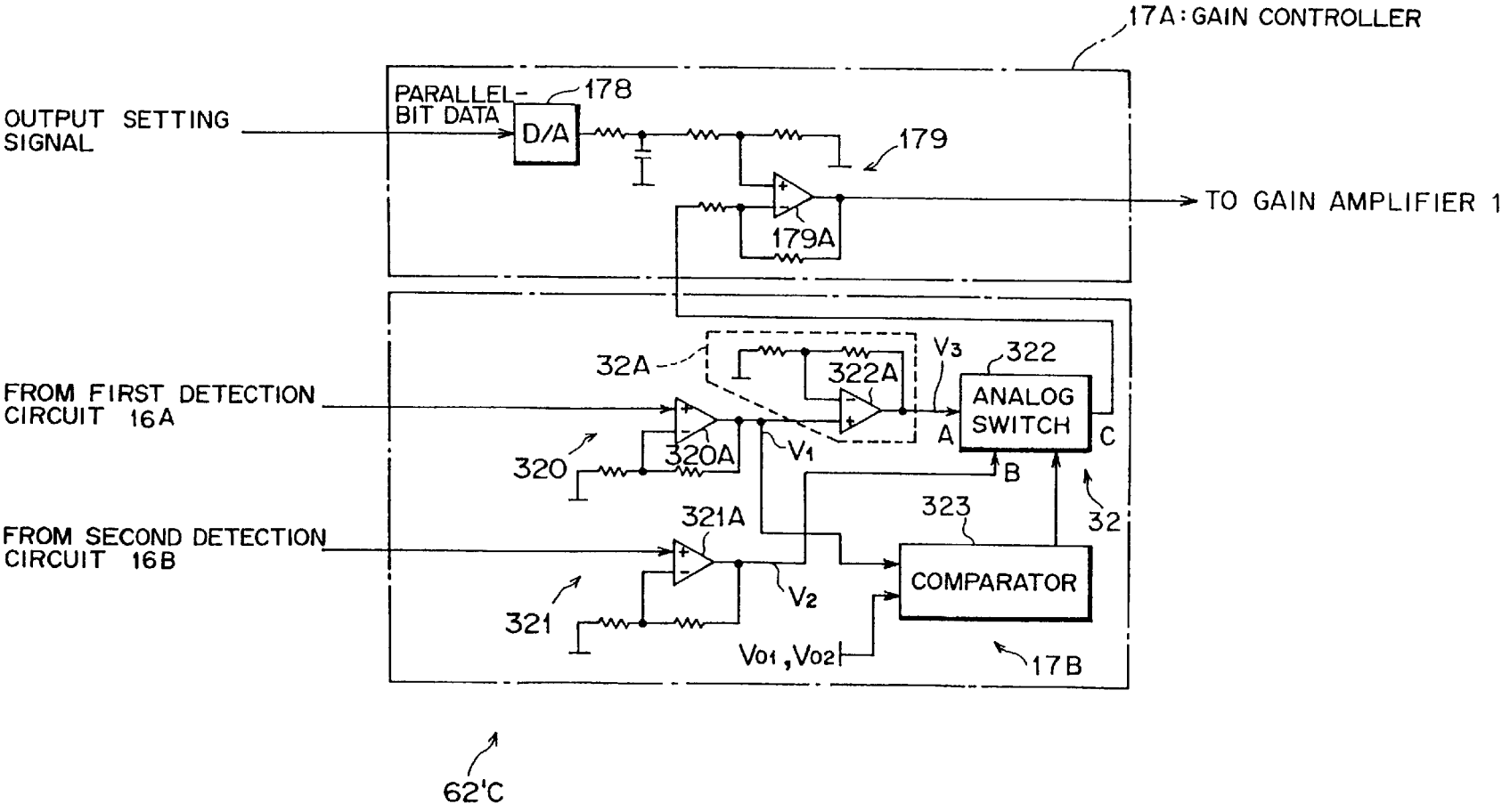
FIG. 19 is a block diagram showing the internal arrangement of the selection control system of the fifth embodiment.

Specifically, as shown in FIG. 19, the selection control system 62' C. consists of a gain controller 17A including a D/A converter 178 and amplifier 179, a second selector switch 32 including amplifiers 320, 321 and 32A and analog switch 322, and a switch controller 17B including a comparator 323. The D/A converter 178, amplifiers 179, 320 and 321 and 32A, analog switch 322 and comparator 323 all function identically to the D/A converter 190, amplifiers 191, 180, 181 and 18A, analog switch 182 and comparator 183 shown in FIG. 15, and detailed explanation thereof will be omitted.

The transmission/reception apparatus 62' amplifies only a transmission monitor signal in need of amplification in the receiver section 62B and employs an inexpensive low-frequency analog switch, instead of a high-frequency analog switch, for the second selector switch 32, whereby the power consumption of the receiver section 62B can be minimized and the parts cost can be reduced, and it contributes significantly to the flexible system organization.

(f) Embodiment 6

Figure 20:
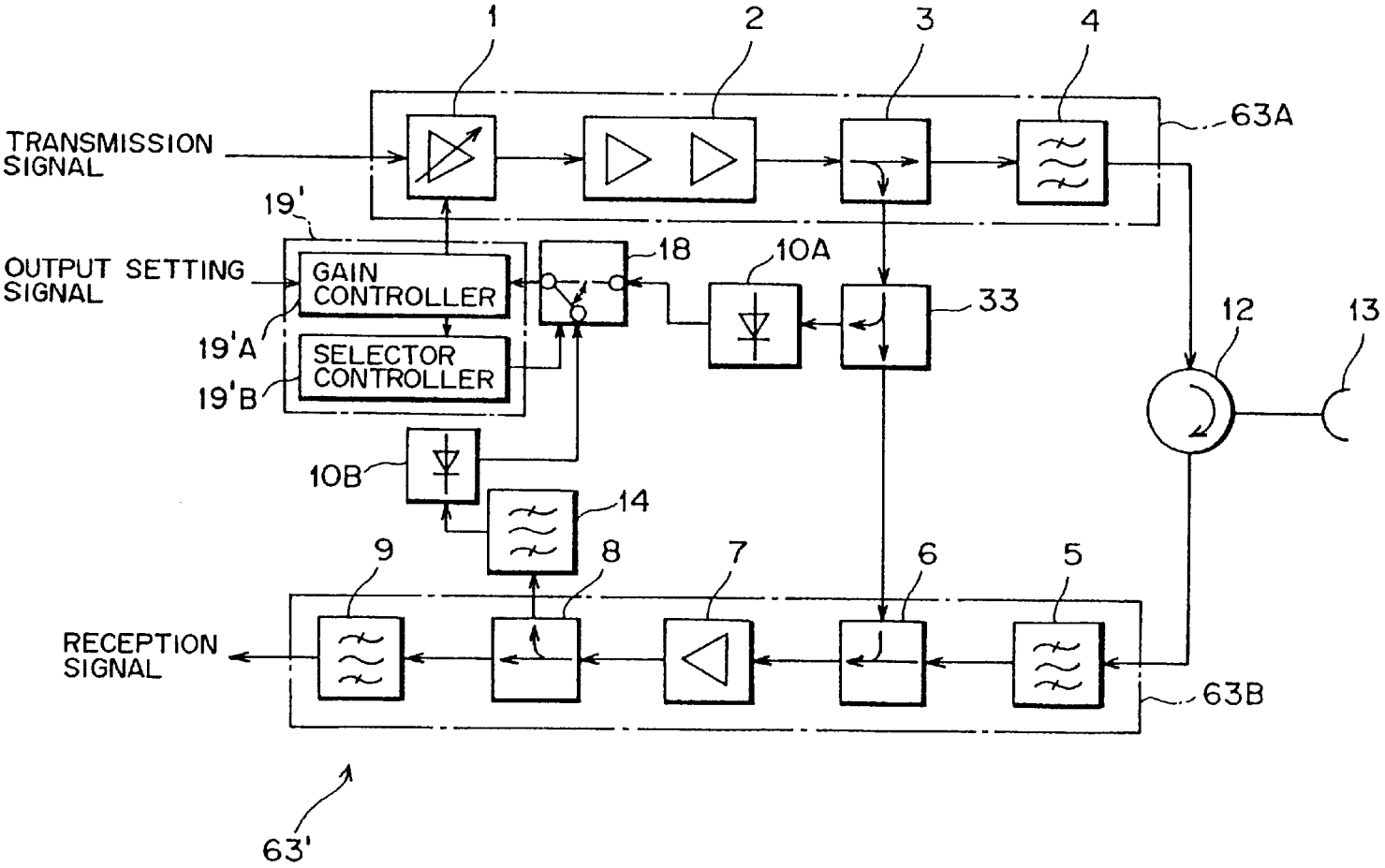
FIG. 20 is a block diagram showing the arrangement of the transmission/reception apparatus based on a sixth embodiment of this invention.

The transmission/reception apparatus 63 of the preceding fourth embodiment, in which the selector 18 is formed of an analog switch controlled by a comparator, can be modified to employ a selector switch for the selector 18 as shown in FIG. 20 as a transmission/reception apparatus 63'. In the figure, circuit sections identical to those of the preceding embodiments are referred to by the common symbols, and detailed explanation thereof will be omitted.

The transmission/reception apparatus 63' of this embodiment shown in FIG. 20 has its controller 19' operating the switch of the selector 18 similar to the controller 17 of the third embodiment so that the gain amplifier 1 is controlled based on the output of the selector 18 and a prescribed control reference. Namely, the transmission/reception apparatus 63' of this embodiment is derived from the transmission/reception apparatus 63 of the fourth embodiment, with its controller 19 being replaced with the controller 17 of the third embodiment.

Figure 21:
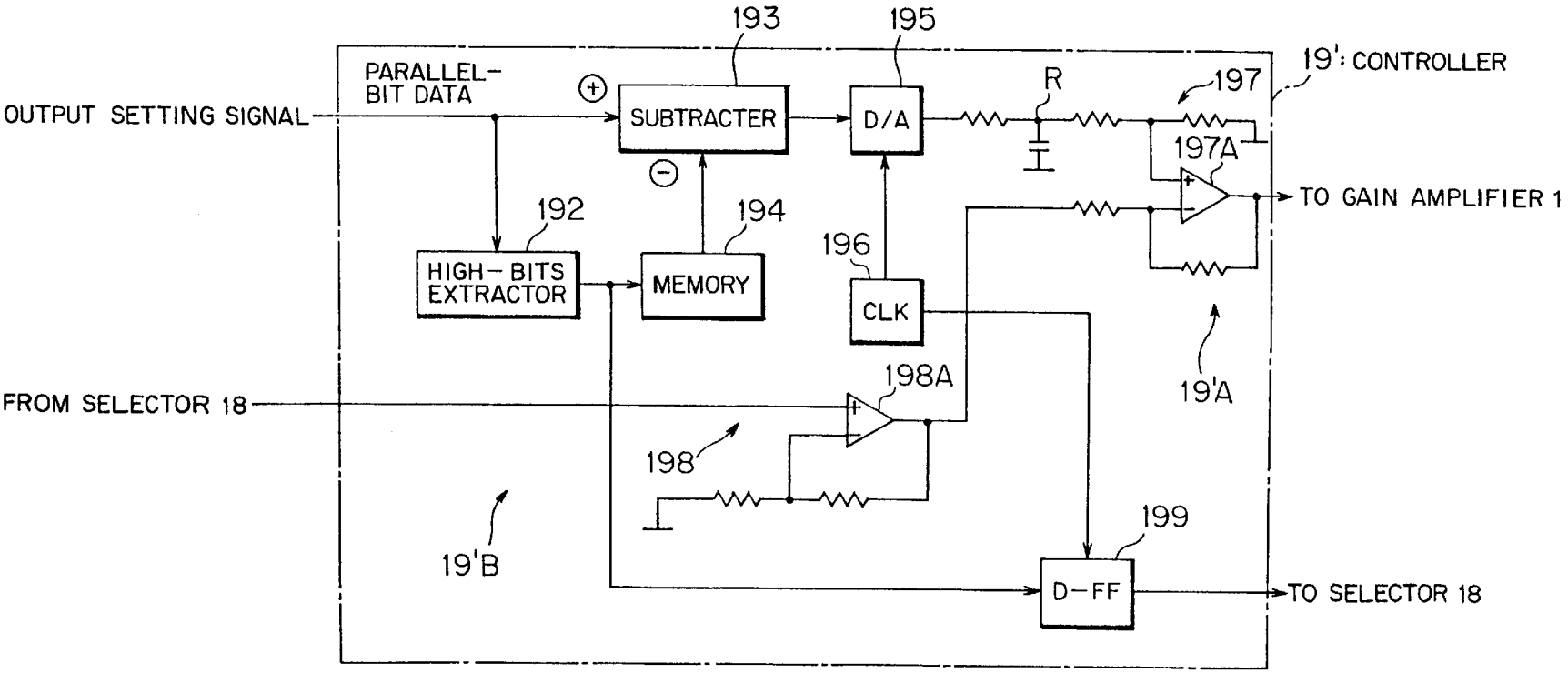
FIG. 21 is a block diagram showing the internal arrangement of the controller of the sixth embodiment.
Figure 22:
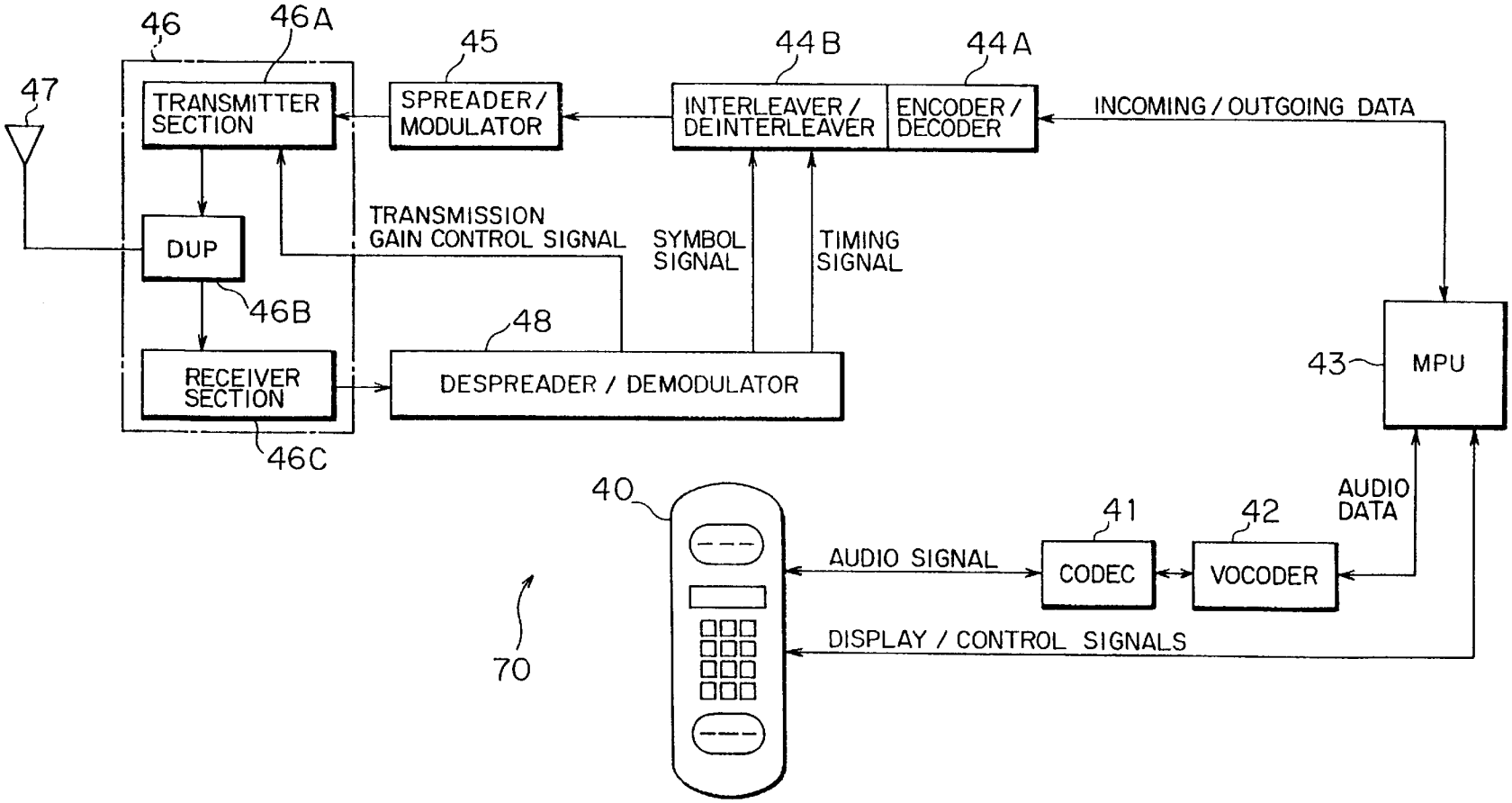
FIG. 22 RELATED ART
FIG. 22 is a block diagram showing the arrangement of the general CDMA terminal equipment.
Figure 23:
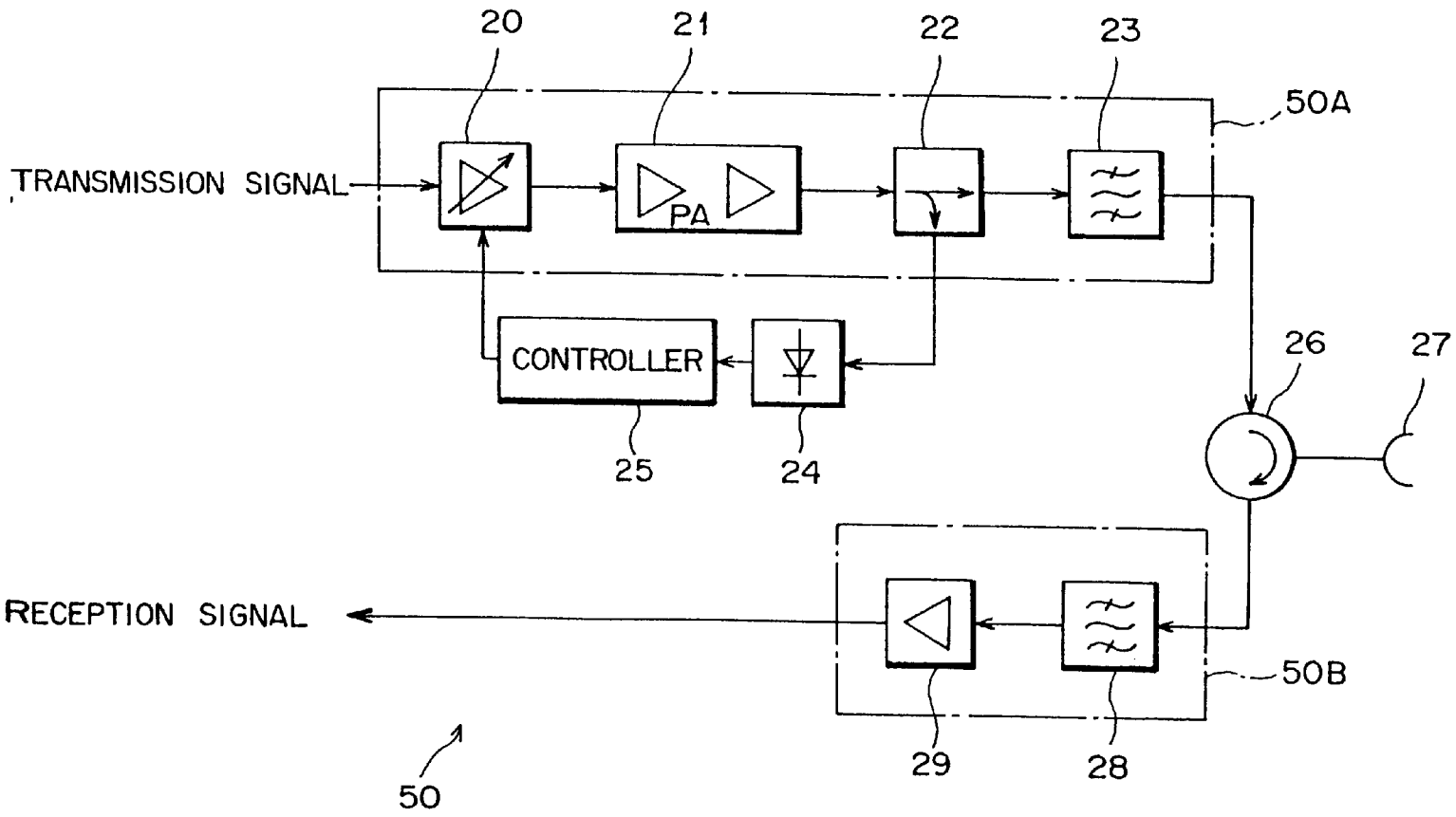
FIG. 23 RELATED ART
FIG. 23 is a block diagram showing the arrangement of the general transmission/reception apparatus.

Specifically, as shown in FIG. 21, the controller 19' includes a high-bits extractor 192, subtracter 193, memory 194, D/A converter 195, clock generator (CLK) 196, amplifiers 197 and 198, and latch circuit (D-type flip-flop; D-FF) 199. These circuit sections function identically to the high-bits extractor 170, subtracter 171, memory 172, D/A converter 173, clock generator 174, amplifiers 175 and 176, and latch circuit 177 shown in FIG. 13, and detailed explanation thereof will be omitted.

The transmission/reception apparatus 63' controls the switching operation of the selector 18 with a simple device, whereby the scale of circuit can be reduced, and it contributes significantly to the flexible system organization.

I claim:

1. A transmission/reception apparatus comprising:

a transmitter section including a gain amplifier which amplifies variably the transmission signal, power amplifier which amplifies the output of said gain amplifier, and transmission monitor signal extractor which extracts a transmission monitor signal from the transmission signal produced by said power amplifier;

a receiver section including a coupler which couples the output of said transmission monitor signal extractor to the reception signal, low-noise amplifier which amplifies the output of said coupler, and separator which separates the output of said low-noise amplifier; and a controller including at least a gain controller which controls said gain amplifier based on a prescribed control reference and the output of said separator.

2. A transmission/reception apparatus according to claim 1 further including:

a variable attenuator which is inserted on the path between said transmission monitor signal extractor and said coupler and adapted to attenuate variably the transmission monitor signal; and a variable attenuation controller which controls the degree of attenuation of said variable attenuator depending on the transmission signal level.

3. A transmission/reception apparatus according to claim 2, wherein said variable attenuation controller operates to increase the degree of attenuation of said variable attenuator in a first mode of high transmission signal level or decrease the degree of attenuation of said variable attenuator in a second mode of low transmission signal level.

4. A transmission/reception apparatus according to claim 1 further including:

a first selector switch which is inserted on the path between said transmission monitor signal extractor and said coupler and adapted to direct the transmission monitor signal selectively depending on the transmission signal level;

a second selector switch which is inserted on the path between said separator and said gain controller and adapted to direct selectively the output of said separator or the output of said first selector switch to said gain controller; and a switch controller which is included in said controller and adapted to operate said first selector switch to have its output directed to said second selector switch and operate said the second selector switch to have its input receiving the output of said first selector switch in a first mode of high transmission signal level, or operate said first selector switch to have its output directed to said coupler and operate said second selector switch to have its input receiving the output of said separator in a second mode of low transmission signal level.

5. A transmission/reception apparatus according to claim 1 further including:

a distributor which is inserted on the path between said transmission monitor signal extractor and said coupler and adapted to distribute the transmission monitor signal in a prescribed proportion;

a selector which directs selectively the output of said separator or the output of said distributor to said gain controller; and a selector controller which is included in said controller and adapted to control said selector to select the output of said distributor in a first mode of high transmission signal level or select the output of said separator in a second mode of low transmission signal level.

6. A transmission/reception apparatus according to claim 1 further including a detection circuit which implements the detection of the transmission monitor signal and delivers the detection output to said gain controller.

7. A transmission/reception apparatus according to claim 1 further including a filter located on the output side of said separator and adapted to render the band confinment for the transmission signal.

8. A transmission/reception apparatus according to claim 1 further including a filter inserted on the path between said separator and said gain controller and adapted to render the band confinment for the reception signal.

* * * * *